US011801419B2

(12) United States Patent
Bissonnette et al.

(10) Patent No.: US 11,801,419 B2
(45) Date of Patent: Oct. 31, 2023

(54) SYSTEM, METHOD AND APPARATUS FOR REHABILITATION AND EXERCISE WITH MULTI-CONFIGURABLE ACCESSORIES

(71) Applicant: REHAB2FIT TECHNOLOGIES, INC., Longmont, CO (US)

(72) Inventors: Michael Bissonnette, Denver, CO (US); Philip Powers, Denver, CO (US); James D. Steidl, San Diego, CA (US)

(73) Assignee: REHAB2FIT TECHNOLOGIES, INC., Longmont, CO (US)

( * ) Notice: Subject to any disclaimer, the term of this patent is extended or adjusted under 35 U.S.C. 154(b) by 175 days.

(21) Appl. No.: 16/874,966

(22) Filed: May 15, 2020

(65) Prior Publication Data

US 2020/0368574 A1 Nov. 26, 2020

Related U.S. Application Data

(60) Provisional application No. 62/852,101, filed on May 23, 2019.

(51) Int. Cl.
*A63B 22/00* (2006.01)
*A63B 22/06* (2006.01)
(Continued)

(52) U.S. Cl.
CPC ..... *A63B 22/0012* (2013.01); *A63B 21/0023* (2013.01); *A63B 21/4035* (2015.10);
(Continued)

(58) Field of Classification Search
CPC ..... A63B 2230/00; A63B 2230/01; A63B 2230/015; A63B 2023/003;
(Continued)

(56) References Cited

U.S. PATENT DOCUMENTS 1,820,372 A * 8/1931 Blomquist ..... A63B 22/001 482/62
3,017,180 A * 1/1962 Aronsohn ..... A63B 21/00178 482/138
(Continued)

FOREIGN PATENT DOCUMENTS

CN 111790111 A 10/2020
CN 114632302 A 6/2022
(Continued)

OTHER PUBLICATIONS

STIC search (Year: 2022).*
(Continued)

*Primary Examiner* — Loan B Jimenez
*Assistant Examiner* — Thao N Do
(74) *Attorney, Agent, or Firm* — Dickinson Wright PLLC; Stephen A. Mason; Jonathan H. Harder

(57) ABSTRACT

A system, method and apparatus for exercise and rehabilitation includes a frame coupled to a base and having a top end. An arm having a proximal end can be coupled to the top end of the frame. A distal end of the arm is opposite the proximal end. The arm is movable in a first degree of freedom between a retracted position and an extended position relative to the frame. Handles are coupled to the arm adjacent the distal end and movable in a second degree of freedom relative to the arm. The handles are manipulated by a user for exercise and rehabilitation.

13 Claims, 21 Drawing Sheets

(51) Int. Cl.
*A63B 21/002* (2006.01)
*A63B 21/00* (2006.01)
*A63B 23/12* (2006.01)
*A63B 71/06* (2006.01)

(52) U.S. Cl.
CPC ..... *A63B 22/0046* (2013.01); *A63B 22/0605* (2013.01); *A63B 23/12* (2013.01); *A63B 2022/0094* (2013.01); *A63B 2022/0611* (2013.01); *A63B 2022/0652* (2013.01); *A63B 2071/0658* (2013.01); *A63B 2225/09* (2013.01); *A63B 2225/093* (2013.01)

(58) Field of Classification Search
CPC ..... A63B 2023/006; A63B 2023/0441; A63B 2023/0447; A63B 2023/0452; A63B 21/00178; A63B 21/00181; A63B 21/00185; A63B 21/0051; A63B 21/0058; A63B 21/0023; A63B 22/0002; A63B 22/001; A63B 22/0087; A63B 22/0012; A63B 22/0046; A63B 2022/0094; A63B 2022/0611; A63B 2022/0652; A63B 2225/09; A63B 2225/093; A63B 2071/0658; A63B 2208/0228; A61H 1/0214; A61H 1/0237; A61H 1/0255; A61H 1/0274
USPC ..... 482/62
See application file for complete search history.

(56) References Cited

U.S. PATENT DOCUMENTS 3,213,852 A * 10/1965 Zent ..... A63B 22/001 601/36
3,572,699 A * 3/1971 Nies ..... A63B 22/0605 601/36
4,222,376 A * 9/1980 Praprotnik ..... A61H 1/0214 601/24
4,519,604 A * 5/1985 Arzounian ..... A63B 22/0087 601/36
4,538,804 A 9/1985 Zibell
4,572,501 A * 2/1986 Durham ..... A63B 22/001 601/36
4,618,141 A * 10/1986 Ashworth, Jr. .... A63B 22/0005 482/62
4,824,132 A * 4/1989 Moore ..... A61G 5/10 280/250.1
4,860,763 A 8/1989 Schminke
5,139,255 A 8/1992 Sollami
5,184,991 A * 2/1993 Brangi ..... A63B 23/03583 482/137
5,277,684 A * 1/1994 Harris ..... A63B 23/03533 482/121
5,336,147 A * 8/1994 Sweeney, III ..... A63B 22/0012 74/594.1
5,338,272 A * 8/1994 Sweeney, III ..... A63B 22/0005 74/594.1
5,447,480 A * 9/1995 Fulks ..... A63B 23/03566 482/99
5,549,533 A * 8/1996 Olson ..... A63B 21/4031 482/137
5,681,247 A * 10/1997 Webber ..... A63B 21/4047 482/137
5,810,701 A * 9/1998 Ellis ..... A63B 23/12 482/136
5,857,943 A 1/1999 Murray
5,916,065 A * 6/1999 McBride ..... A63B 22/001 482/57
5,938,570 A * 8/1999 Maresh ..... A63B 22/0664 482/57
5,980,431 A * 11/1999 Miller, Jr. ..... A63B 22/0012 482/57
5,997,446 A * 12/1999 Stearns ..... A63B 21/4047 482/56
6,004,246 A * 12/1999 Sencil ..... A63B 23/0233 482/145
6,015,370 A * 1/2000 Pandozy ..... A63B 23/0233 482/142
6,036,623 A * 3/2000 Mitchell ..... A63B 23/03575 482/57
6,652,425 B1 * 11/2003 Martin ..... A63B 21/154 482/57
6,840,892 B1 * 1/2005 Wu ..... A63B 22/0005 482/62
6,902,515 B2 * 6/2005 Howell ..... A63B 22/0012 482/57
6,960,155 B2 * 11/2005 Chien ..... A63B 22/0005 482/62
7,381,162 B2 * 6/2008 Kuo ..... A63B 22/0605 482/57
7,510,512 B1 * 3/2009 Taggett ..... A63B 21/0088 482/111
7,713,176 B1 * 5/2010 Farney ..... A63B 21/0054 482/52
7,736,281 B2 * 6/2010 Corbalis ..... A63B 22/0605 482/57
7,837,472 B1 11/2010 Elsmore et al.
8,113,996 B1 * 2/2012 Allen ..... A63B 22/0005 482/57
8,409,060 B2 * 4/2013 Hsu ..... A63B 21/4041 482/57
8,444,534 B2 5/2013 Mckee
8,818,496 B2 8/2014 Dziubinski et al.
9,272,186 B2 3/2016 Reich
9,486,382 B1 11/2016 Boss
9,925,412 B1 * 3/2018 Lu ..... A63B 22/001
9,987,188 B1 6/2018 Diao
D826,349 S * 8/2018 Oblamski ..... D21/665
10,130,311 B1 11/2018 De Sapio et al.
10,173,094 B2 * 1/2019 Gomberg ..... A63B 69/16
10,173,095 B2 1/2019 Gomberg et al.
10,173,096 B2 1/2019 Gomberg et al.
10,173,097 B2 1/2019 Gomberg et al.
10,226,663 B2 3/2019 Gomberg et al.
10,278,883 B2 5/2019 Walsh
10,532,000 B1 1/2020 De Sapio
10,532,785 B2 1/2020 Stillman
10,646,746 B1 5/2020 Gomberg et al.
10,946,239 B2 3/2021 Berry
11,093,904 B2 8/2021 Humble
11,311,772 B1 * 4/2022 Cooper ..... A63B 21/4035
11,325,005 B2 * 5/2022 Mason ..... G06N 20/00
11,386,176 B2 7/2022 Galitsky
11,433,276 B2 9/2022 Bissonnette
11,458,354 B2 * 10/2022 Bissonnette ..... A63B 23/03516
11,458,363 B2 10/2022 Powers et al.
2001/0031685 A1 * 10/2001 Maresh ..... A63B 22/0664 482/52
2004/0023762 A1 * 2/2004 Lull ..... A63B 23/0405 482/99
2004/0259693 A1 * 12/2004 Chien ..... A63B 22/0694 482/57
2005/0101463 A1 5/2005 Chen
2006/0079817 A1 4/2006 Dewald
2006/0122039 A1 * 6/2006 Lee ..... A63B 22/0005 482/57
2006/0135325 A1 6/2006 Holness
2006/0229164 A1 10/2006 Einav
2006/0252607 A1 11/2006 Holloway
2006/0258520 A1 11/2006 Bowser
2007/0021277 A1 * 1/2007 Kuo ..... A63B 22/0605 482/57
2007/0099766 A1 5/2007 Pyles
2007/0149364 A1 6/2007 Blau
2007/0232464 A1 * 10/2007 Chu ..... A63B 21/4047 482/96
2007/0243980 A1 10/2007 Bowser
2008/0085819 A1 * 4/2008 Yang ..... A63B 22/0605 482/57

(56) References Cited

U.S. PATENT DOCUMENTS

2008/0119333 A1 5/2008 Bowser
2008/0139975 A1 6/2008 Einav
2008/0318738 A1* 12/2008 Chen ..... A63B 21/015 482/57
2009/0221407 A1 9/2009 Hauk
2009/0239714 A1 9/2009 Sellers
2009/0253558 A1* 10/2009 Lofgren ..... A63B 22/0002 482/51
2010/0022354 A1 1/2010 Fisher
2010/0029445 A1* 2/2010 Lee ..... A63B 23/0355 482/62
2010/0035726 A1 2/2010 Fisher
2010/0035729 A1* 2/2010 Pandozy ..... A63B 21/068 482/148
2010/0152629 A1 6/2010 Haas
2010/0234196 A1* 9/2010 Shinomiya ..... A63B 21/00178 482/142
2010/0261585 A1 10/2010 Hauk
2010/0298102 A1 11/2010 Bosecker et al.
2010/0331144 A1 12/2010 Rindfleisch
2011/0118086 A1* 5/2011 Radow ..... A63B 21/00196 482/5
2011/0165995 A1 7/2011 Paulus
2011/0172058 A1 7/2011 Deaconu
2011/0256983 A1 10/2011 Malack
2011/0275486 A1* 11/2011 Hsu ..... A63B 21/4041 482/57
2012/0040799 A1 2/2012 Jaquish
2012/0053028 A1* 3/2012 Campanaro ..... A63B 23/0205 482/131
2012/0232438 A1 9/2012 Cataldi et al.
2012/0238411 A1* 9/2012 McBride ..... A63B 22/0005 482/57
2012/0238413 A1* 9/2012 McBride ..... A63B 22/0605 482/62
2013/0029808 A1* 1/2013 Kuo ..... A63B 22/0605 482/57
2013/0029809 A1 1/2013 Spevak
2013/0116094 A1* 5/2013 Chen ..... A63B 22/0058 482/52
2013/0324376 A1* 12/2013 Colby ..... A63B 21/4035 482/112
2013/0331741 A1* 12/2013 Kuro ..... A63B 23/03508 601/24
2013/0338549 A1* 12/2013 Korenaga ..... A61H 99/00 601/33
2013/0345604 A1* 12/2013 Nakamura ..... A61H 1/00 601/24
2014/0113768 A1 4/2014 Lin et al.
2014/0113776 A1* 4/2014 Jaguan ..... A63B 22/0023 482/57
2014/0195103 A1 7/2014 Nassef
2014/0243160 A1* 8/2014 Lim ..... A63B 22/0605 482/62
2014/0274564 A1 9/2014 Greenbaum
2015/0065303 A1* 3/2015 Born ..... A63B 21/023 482/8
2015/0065305 A1* 3/2015 Dalton ..... A63B 22/0056 482/52
2015/0094192 A1 4/2015 Skwortsow et al.
2015/0165263 A1* 6/2015 Golen, Jr. ..... A63B 22/04 482/7
2015/0258365 A1* 9/2015 Neill ..... A63B 21/0125 482/54
2015/0273267 A1* 10/2015 Manzke ..... A63B 21/012 482/57
2015/0360069 A1 12/2015 Marti et al.
2016/0136483 A1 5/2016 Reich
2016/0184634 A1 6/2016 Yanev
2016/0220867 A1 8/2016 Flaherty
2016/0271438 A1 9/2016 Weisz
2016/0361597 A1* 12/2016 Cole ..... A63B 22/0087
2017/0003311 A1 1/2017 Lay
2017/0021827 A1 1/2017 Seagraves
2017/0036055 A1 2/2017 Fleming
2017/0065849 A1 3/2017 Konishi
2017/0100628 A1 4/2017 Wilt
2017/0136295 A1* 5/2017 Tholkes ..... A61B 5/4566
2017/0144008 A1* 5/2017 Brown ..... A63B 3/00
2017/0361165 A1 12/2017 Miller
2018/0008861 A1* 1/2018 Abelbeck ..... A63B 24/0087
2018/0036593 A1 2/2018 Ridgel et al.
2018/0064991 A1 3/2018 Yanev
2018/0096111 A1 4/2018 Wells et al.
2018/0154204 A1* 6/2018 Bayerlein ..... A61H 1/0277
2018/0178059 A1 6/2018 Hyungsoon et al.
2018/0185698 A1* 7/2018 Anderson ..... A63B 22/001
2018/0228682 A1* 8/2018 Bayerlein ..... A63B 21/00181
2018/0264312 A1 9/2018 Pompile et al.
2018/0272184 A1* 9/2018 Vassilaros ..... B62M 3/02
2018/0326243 A1 11/2018 Badi et al.
2019/0060699 A1 2/2019 Frederick et al.
2019/0183715 A1 6/2019 Kapure et al.
2019/0192912 A1 6/2019 Radow
2019/0247718 A1 8/2019 Blevins
2019/0262655 A1 8/2019 Lentine
2019/0275368 A1 9/2019 Maroldi
2019/0290965 A1 9/2019 Oren
2020/0085300 A1 3/2020 Kwatra et al.
2020/0114207 A1 4/2020 Weldemariam
2020/0171346 A1* 6/2020 Chen ..... A63B 22/205
2020/0276470 A1* 9/2020 Howett ..... A63B 22/205
2021/0035674 A1 2/2021 Volosin et al.
2021/0113877 A1 4/2021 Chin
2021/0245003 A1 8/2021 Turner
2021/0268335 A1 9/2021 Mizukura
2022/0001232 A1* 1/2022 DeForest, Jr. ..... A63B 22/001
2022/0072362 A1 3/2022 Hopson
2022/0238222 A1 7/2022 Neuberg
2022/0266094 A1 8/2022 Mason et al.
2022/0415469 A1 12/2022 Mason
2022/0415471 A1 12/2022 Mason
2023/0001268 A1 1/2023 Bissonnette et al.
2023/0013530 A1 1/2023 Mason
2023/0014598 A1 1/2023 Mason et al.
2023/0048040 A1 2/2023 Hacking et al.
2023/0051751 A1 2/2023 Hacking et al.
2023/0058605 A1 2/2023 Mason
2023/0060039 A1 2/2023 Mason
2023/0072368 A1 3/2023 Mason et al.
2023/0078793 A1 3/2023 Mason
2023/0119461 A1 4/2023 Mason

FOREIGN PATENT DOCUMENTS

EP 0383137 A2 8/1990
EP 1391179 A1 2/2004
EP 3671700 A1 6/2020
GB 2512431 A 10/2014
KR 20140128630 A 11/2014
KR 20200029180 A 3/2020
KR 20210052028 A 5/2021
TW 200910231 A 3/2009
TW 201531278 A 8/2015
WO 02062211 A2 8/2002
WO 2009008968 A1 1/2009
WO 2014163976 A1 10/2014
WO 2015112945 A1 7/2015
WO 2017166074 A1 5/2017
WO 2020229705 A1 11/2020
WO 2021022003 A1 2/2021

OTHER PUBLICATIONS

U.S. Appl. No. 16/812,462, filed Mar. 9, 2020, and titled "System, Method and Apparatus for Adjustable Pedal Crank", by Peter Arn, et al.

U.S. Appl. No. 16/813,158, filed Mar. 9, 2020, and titled "System, Method and Apparatus for a Rehabilitation Machine With a Simulated Flywheel", by S. Adam Hacking, et al.

(56) References Cited

OTHER PUBLICATIONS

U.S. Appl. No. 16/813,303, filed Mar. 9, 2020, and titled "Control System for a Rehabilitation and Exercise Electromechanical Device", by S. Adam Hacking, et al.
U.S. Appl. No. 16/813,224, filed Mar. 9, 2020, and titled "System, Method and Apparatus for Electrically Actuated Pedal for an Exercise or Rehabilitation Machine", by S. Adam Hacking, et al.
Malloy, Online Article "AI-enabled EKGs find difference between numerical age and biological age significantly affects health, longevity", Website: https://newsnetwork.mayoclinic.org/discussion/ai-enabled-ekgs-find-difference-between-numerical-age-and-biological-age-significantly-affects health-longevity/, Mayo Clinic News Network, May 20, 2021, retrieved: Jan. 23, 2023, p. 1-4.
Jeong et al., "Computer-assisted upper extremity training using interactive biking exercise (iBikE) platform," Sep. 2012, pp. 1-5, 34th Annual International Conference of the IEEE EMBS.

* cited by examiner

SYSTEM, METHOD AND APPARATUS FOR REHABILITATION AND EXERCISE WITH MULTI-CONFIGURABLE ACCESSORIES

This application claims priority to and the benefit of U.S. Prov. Pat. App. No. 62/852,101, filed May 23, 2019, which is incorporated herein by reference in its entirety.

BACKGROUND

Technical Field

This disclosure generally relates to exercise and, in particular, to a system, method and apparatus for a rehabilitation and exercise device with multi-configurable accessories.

Description of the Related Art

Devices for user rehabilitation and exercise can be used to facilitate osteogenesis and muscle hypertrophy. Such machines typically provide for one type of static or dynamic activity for a user to facilitate osteogenesis and muscle hypertrophy. For users with limited mobility, moving between different machines that facilitate only one type of activity can present challenges that limit the ability of the user to rehabilitate and exercise.

Conventional devices can include handles for user engagement. The handles are in fixed locations such that the handles may interfere with other uses of the machine. For those users with limited mobility, positioning of the handles can present challenges that may limit the user's ability to engage in exercise and rehabilitation. Accordingly, there is a need for a machine configured to provide handles for use in exercise and rehabilitation, while also allowing the handles to be moved to a retracted position such that the handles do not interfere with other uses of the machine. Although conventional solutions are workable, improvements continue to be of interest.

SUMMARY

Embodiments of a system, method and apparatus for exercise and rehabilitation are disclosed. For example, the apparatus can include a frame coupled to a base and having a top end. An arm having a proximal end can be coupled to the top end of the frame. A distal end of the arm is opposite the proximal end. The arm is movable in a first degree of freedom between a retracted position and an extended position relative to the frame. Handles can be coupled to the arm adjacent the distal end and movable in a second degree of freedom relative to the arm. The handles are configured to be manipulated by a user for exercise and rehabilitation.

BRIEF DESCRIPTION OF THE DRAWINGS

For a detailed description of example embodiments, reference will now be made to the accompanying drawings in which.

NOTATION AND NOMENCLATURE

Figure 1:
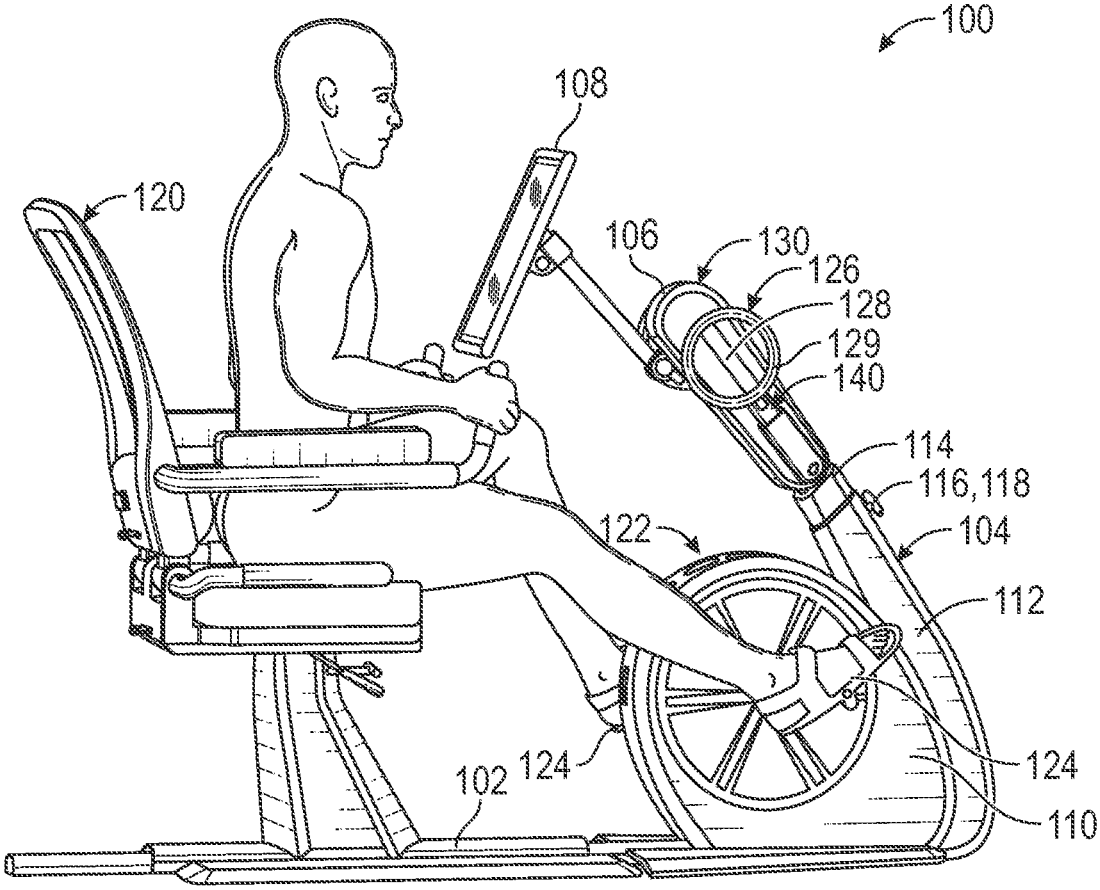
FIG. 1 is a side view of an embodiment of an exercise and rehabilitation apparatus with arms in a retracted position.

Various terms are used to refer to particular system components. Different companies may refer to a component by different names—this document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

The terminology used herein is for the purpose of describing particular example embodiments only, and is not intended to be limiting. As used herein, the singular forms "a," "an," and "the" may be intended to include the plural forms as well, unless the context clearly indicates otherwise. The method steps, processes, and operations described herein are not to be construed as necessarily requiring their performance in the particular order discussed or illustrated, unless specifically identified as an order of performance. It is also to be understood that additional or alternative steps may be employed.

The terms first, second, third, etc. may be used herein to describe various elements, components, regions, layers and/or sections; however, these elements, components, regions, layers and/or sections should not be limited by these terms. These terms may be only used to distinguish one element, component, region, layer or section from another region, layer or section. Terms such as "first," "second," and other numerical terms, when used herein, do not imply a sequence or order unless clearly indicated by the context. Thus, a first element, component, region, layer or section discussed below could be termed a second element, component, region, layer or section without departing from the teachings of the example embodiments. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C. In another example, the phrase "one or more" when used with a list of items means there may be one item or any suitable number of items exceeding one.

Spatially relative terms, such as "inner," "outer," "beneath," "below," "lower," "above," "upper," "top," "bottom," and the like, may be used herein. These spatially relative terms can be used for ease of description to describe one element's or feature's relationship to another element(s) or feature(s) as illustrated in the figures. The spatially relative terms may also be intended to encompass different orientations of the device in use, or operation, in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptions used herein interpreted accordingly.

DETAILED DESCRIPTION

The subject matter of each of U.S. Pat. No. 10,226,663, issued Mar. 12, 2019; U.S. Pat. No. 10,173,094, issued Jan. 8, 2019; U.S. Pat. No. 10,173,095, issued Jan. 8, 2019; U.S. Pat. No. 10,173,096, issued Jan. 8, 2019; U.S. Pat. No. 10,173,097, issued Jan. 8, 2019; and U.S. Pat. No. 10,646,746, issued May 12, 2020; and U.S. pending patent applications Ser. No. 16/812,462 filed Mar. 9, 2020; U.S. Ser. No. 16/813,158 filed Mar. 9, 2020; Ser. No. 16/813,224 filed Mar. 9, 2020; and Ser. No. 16/813,303 filed Mar. 9, 2020, is incorporated herein by reference.

The following discussion is directed to various embodiments. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

As shown in FIGS. 1-26, various embodiments of an exercise and rehabilitation apparatus, hereinafter called "the apparatus," are provided. The apparatus may take the form of a first apparatus 100, which is shown, by way of example, in FIGS. 1-15, and 26. Alternatively or additionally, the apparatus may take the form of a second apparatus 200, which is shown, by way of example, in FIGS. 17-19. Alternatively or additionally still, the apparatus may take the form of a third apparatus 300, which is shown, by way of example, in FIGS. 20-26. The apparatus may take other forms, which may include any combination of features or functions shown or described with respect to any of the example embodiments 100, 200, 300.

"Latch," as used herein, refers to a coupling mechanism which may be, without limitation, realized by hydraulic, magnetic, electrical, mechanical, electromagnetic, frictional, thermodynamic, hydrostatic, or other means; and capable, in further embodiments, of being locked with a locking device or pin, whether using any of the foregoing means or, instead, or in addition thereto, any combination of biometric or electronic ones.

FIG. 1 shows a perspective view of the first apparatus 100, which includes a base 102 configured to rest on a ground surface, and a frame 104 coupled to the base 102. The frame 104 defines a top end 106 that is spaced away from the base 102. The frame 104 extends generally transversely to the base 102, and may extend vertically upwardly from the base 102, with the base 102 resting on the ground surface. In some embodiments, the top end 106 may be a portion of the frame 104 farthest from the base 102. However, the frame 104 may include one or more devices or structures that extend farther from the base 102 beyond the top end 106. For example, a display screen 108 mounted to the frame 104 may be positioned such that it extends higher than the top end 106, as shown in FIG. 1. The first apparatus 100 includes an enclosure 108. The enclosure 108 may serve other functions, such as holding mechanical and/or electrical components of first apparatus 100 and protecting those components from contacting a user or a bystander and/or preventing those components from being damaged, such as when the apparatus is being used, stored, or transported.

In some embodiments, the frame 104 may be movable relative to the base 102. Alternatively, the frame 104 may be rigidly fixed to the base 102. For example, the frame 104 may be secured to the base 102 with a welded connection or with one or more fasteners such as bolts or screws. The frame 104 may be integrally formed with the base 102. For example, the frame 104 and the base 102 may each include a common structure (not shown), such as one or more tubes or a unitary casting. The common structure may form a structural portion of one or both of the frame 104 and the base 102. One or both of the frame 104 and the base 102 may include other components in addition to the structural portion, such as mechanical, electrical, and/or trim components. In some embodiments, the frame 104 may include a structural support (not shown), such as a cast or welded metal core.

In the example embodiment shown in FIG. 1, the frame 104 includes a lower member 112 adjacent to the base 102 and attached thereto. The frame 104 also includes an upper member 114 spaced apart from the base 102 and including the top end 106. The upper member 114 is movable relative to the lower member 112, which may allow the upper member 114 to be adjusted to a variety of different positions. Alternatively or additionally, the upper member 114 may be fully removed from the lower member 112, which may allow it to be substituted for different hardware. This is described in more detail, below, with reference to FIGS. 10-12. The example first apparatus 100 includes a lock 116 to secure the upper member 114 together with the lower member 112. The lock 116 may include a knob 118, as shown in FIG. 1, for ease of handling and use. The lock 116 may include one or more different connection devices, which may include, for example, a threaded rod, a pin, or a cam lock.

In some embodiments, and as shown in FIG. 1, the first apparatus 100 includes a seat 120 configured to support the user, and which may be coupled to the base 102 and spaced apart from the frame 104. The seat 120 may be adjustable in position and/or orientation to accommodate users of different sizes or for users to perform different exercises with the first apparatus 100. In some embodiments, the apparatus includes a cycle mechanism 122, which may be integrated with the lower member 112 of the frame 104. The cycle mechanism 122 includes a set of pedals 124 configured to be turned by the user sitting upon the seat 120.

The first apparatus 100 includes a handgrip assembly 126 configured to be grasped by the user. In addition, the handgrip assembly 126 can be attached to an arm 130. In some embodiments, and as shown in FIGS. 1-9, the handgrip assembly 126 includes a handlebar 128 configured to be grasped by the user and which is surrounded by a ring 129. The handlebar 128 has a generally cylindrical shape, although other shapes are possible, such as, for example, an oval-shaped cross-section or a shape corresponding to the interior of a person's grasped hand. The ring 129 may be generally circular, as shown in the drawings, or the ring 129 may have a different shape, such as a semi-circle, or a 3-dimensional as shape, such as a quarter of a sphere. While the user is grasping the handlebar 128, the ring 129 may serve as a guard to surround all or part of the user's hand. Alternatively or additionally, the user may grasp the ring 129 directly, therefore providing for different hand positions, which may be used for performing various exercises and/or to suit the preference of the user. The handlebar 128 and/or the ring 129 may include one or more different materials, such as foam rubber, and/or hard plastic, each of which may enable different tactile experiences for the user. For example, as shown in FIG. 1, the ring 129 may have a reflective and/or brightly colored inner portion facing radially inwardly, and a dark or matte finished outer portion facing radially outwardly.

The arm 130 is configured to be movable in a first degree of freedom between a retracted position and an extended position relative to the frame 104. As shown in the FIGS., example configurations are provided in which the arm 130 is configured as a boom arm. However, the arm 130 may have other configurations or arrangements. FIG. 1 illustrates an example of the arm 130 in a retracted position, with the arm 130 extending generally parallel to the frame 104. Different embodiments or configurations of the arm 130 may have a retracted position different than the configuration shown in FIG. 1. For example, when in the retracted position, the arm 130 may be detached, rotated, folded, collapsed, or otherwise moved to be clear of a user of the first apparatus 100.

Figure 2:
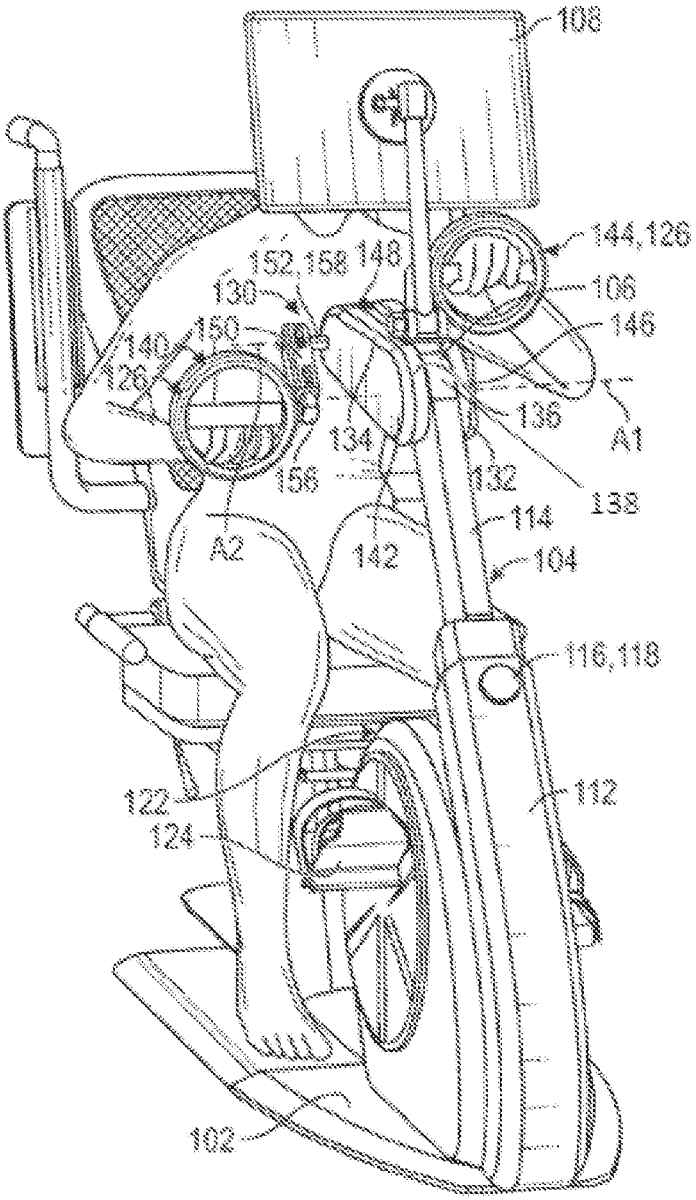
FIG. 2 is a front perspective view of an embodiment of the apparatus of FIG. 1 with the arms in an extended position.

FIG. 2 shows a perspective view of the first apparatus 100 of FIG. 1 with the arm 130 in an extended position, with the arm 130 extending perpendicularly to the frame 104 and parallel to the base 102. The arm 130 may also extend parallel to a ground surface upon which the base 102 rests. The arm 130 may extend generally perpendicularly to the frame 104 in the extended position. In some embodiments, the arm 130 may extend at an oblique angle to the frame 104 in the extended position. In another version, the arm 130 may extend generally parallel to the base 102 in the extended position. The extended position may be different than the configuration shown in FIG. 2. For example, when in the extended position, the arm 130 may be attached, rotated, lengthened, or otherwise moved to a readily reachable and/or convenient operating position for a user of the first apparatus 100. The arm 130 includes a proximal end 132 coupled to the top end 106 of the frame 104, and a distal end 134 opposite the proximal end 132. In some embodiments, and as shown in FIG. 2, the arm 130 may be coupled to the top end 106 of the frame 104 at a first pivot 136 such that the first degree of freedom comprises rotation of the arm 130 about a first axis A1 of the first pivot 136. The first pivot 136 may include one or more bearings and/or bushings, such as a plain bearing or a ball bearing. The first pivot 136 may include an angle sensor to measure the position of the arm 130 relative to the frame 104. Additionally or alternatively, the first pivot 136 may include a load cell configured to measure a torque between the arm 130 and the frame 104.

In some embodiments, the first apparatus 100 includes a first latch 138 which is configured to selectively hold the arm 130 at a given position relative to the frame 104. The first latch 138 may be movable between a latched position in which the arm 130 is prevented from moving, and an unlatched position in which the arm 130 can be easily moved between the retracted position and the extended position. The first latch 138 may include a switch or slider interface, although other configurations may be used for the first latch 138, such as a pin that engages a hole, a rotary latch, a slider, a cam lock, etc. Alternatively or additionally, the first latch 138 may include another mechanism or actuator, such as a hydraulic, magnetic, and/or electric actuator to hold the arm in a given position when activated. The first latch 138 may include other components or devices (not shown) such as a pawl and ratchet, a clamp, a friction device, a pin, and/or a lock that may function to hold the arm 130 in the given position.

Still referring to FIG. 2, the first apparatus 100 includes a handle 140, 144 coupled to the arm 130 adjacent to the distal end 134, and configured to be manipulated by a user. In some embodiments, the first apparatus 100 includes a right handle 140 disposed on a right side 142 of the arm 130 and a left handle 144 disposed on a left side 146 of the arm 130 opposite the right side 142.

The handles 140, 144 are configured to be movable in a second degree of freedom relative to the arm 130. For example, one or both of the handles 140, 144 may include a handle arm 150 coupled to the arm 130 at a second pivot 152 and extending therefrom to a far end 156, such that the second degree of freedom comprises rotation of the handle arm 150 about a second axis A2 of the second pivot 152. The second pivot 152 may include one or more bearings and/or bushings, such as a plain bearing or a ball bearing. The second pivot 152 may include an angle sensor to measure the position of the handle arm 150 relative to the arm 130. Additionally or alternatively, the second pivot 152 may include a load cell configured to measure a torque between the handle arm 150 and the arm 130.

In some embodiments, and as shown in FIG. 2, the second axis A2 may be parallel to and spaced apart from the first axis A1. In some embodiments, and as also shown in FIG. 2, the second pivot 152 may comprise a bar 158 extending along the second axis A2. The bar 158 may be solid or tubular shaped. The bar may include one or more pieces, such as different axial segments. The first apparatus 100 may be used to perform hand-crank type exercises as shown in FIG. 2, with each of the handle arms 150 extending in opposite radial directions from the second axis A2, and with each of the handles 140, 144 being rotated about the second axis A2. A hand-crank type exercise is performed using one or more hands and arms of a user and includes rotational motion, similar to the rotational motion used in pedaling a bicycle.

Figure 3:
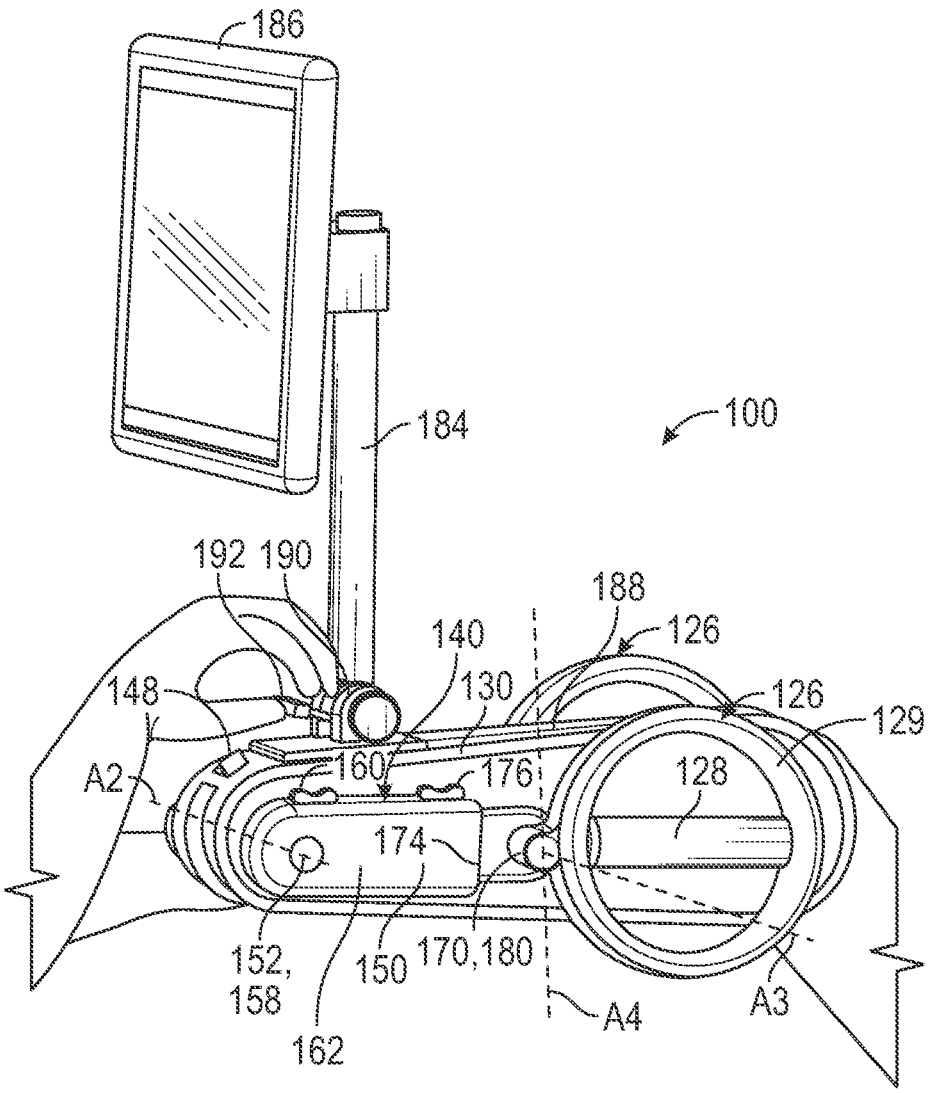
FIG. 3 is an enlarged side view of an embodiment of a portion of the apparatus of FIG. 1 with a handgrip in the retracted position.
Figure 4:
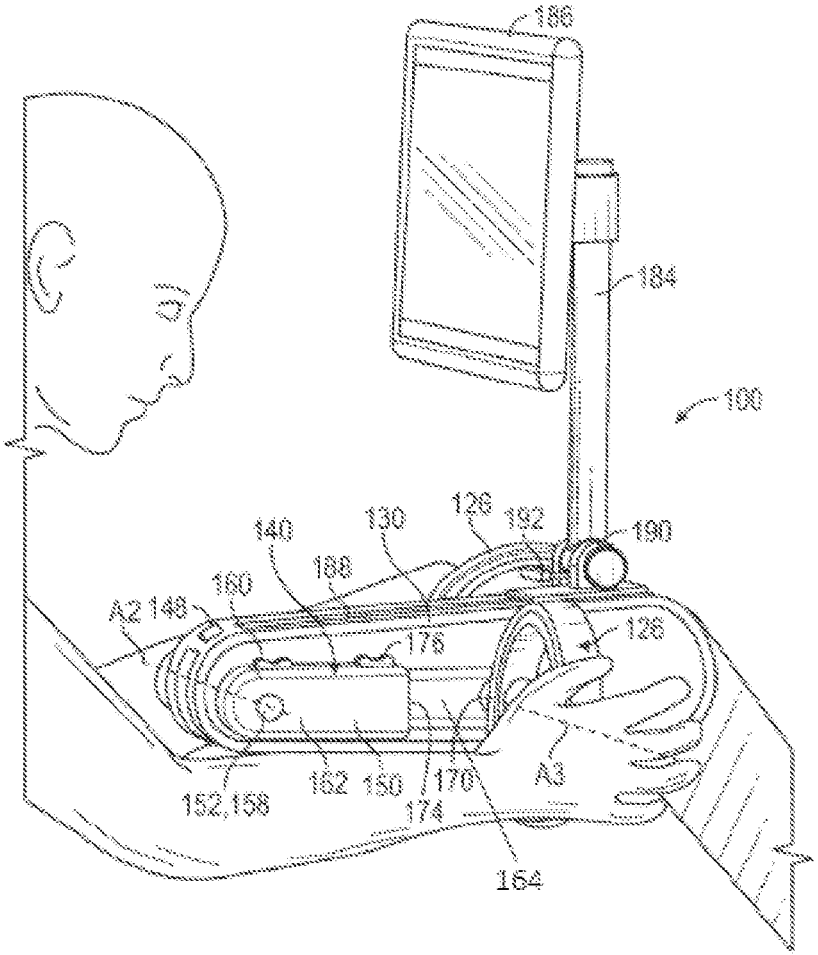
FIG. 4 is a side view of the portion of FIG. 3 with an embodiment of the handgrip is in an extended position.

FIGS. 3-4 show a perspective view of the arm 130 of the first apparatus 100. FIG. 3 shows an example embodiment of the right handle 140 in more detail. The left handle 144 may have a similar construction and operation as the right handle 140, or a mirror-image construction. The first apparatus 100 may also include a second latch 160 configured to selectively couple the handle arm 150 to rotate with the bar 158. The second latch 160 may, therefore, allow the handles 140, 144 to be locked together or to be movable independent of one another. For example, the handles 140, 144 can be moved from a configuration with each of the respective handle arms 150 facing the same direction, such as is shown FIG. 1 to a configuration where each of their respective handle arms 150 extends in opposite directions, as shown in FIG. 2, thereby allowing the handles 140, 144 to be used for hand-crank type exercises. The second latch 160 may include a switch or slider interface, although other configurations may be used for the second latch 160, such as a pin that engages a hole, a rotary latch, a slider, a cam lock, etc. The second latch 160 may include a mechanism or actuator, such as a hydraulic, magnetic, and/or electric actuator to selectively couple the handle arm 150 to rotate with the bar 158 when activated. The second latch 160 may include other components or devices (not shown) such as a pawl and ratchet, a clamp, a friction device, a pin, and/or a lock to selectively couple the handle arm 150 to rotate with the bar 158.

As also shown in FIG. 3, the handle arm 150 comprises a first shaft 162 coupled directly to the arm 130 at the second pivot 152. The handle arm 150 also comprises a second shaft 164 coupled to the handgrip assembly 126 at a third pivot 170, and a telescopic coupling 174 between the first shaft 162 and the second shaft 164 for adjusting the distance between the second pivot 152 and the third pivot 170. In other words, the length of the handle arm 150 may be adjusted using the telescopic coupling 174. It should be appreciated that the telescopic coupling 174 is an illustrative example, and that the length of the handle arm 150 may be adjusted using other configurations or mechanisms. The telescopic coupling 174 may include one or more concentric tubular members. Alternatively or additionally, other joints or mechanisms that provide for changing the length of the handle arm 150 may be used as the telescopic coupling 174. The length of the handle arm 150 may be adjusted using a mechanism that provides linear and/or rigid motion. Such a mechanism may include, for example, a sliding rail, which may be similar to a drawer slide mechanism. The mechanism for adjusting the length of the handle arm 150 may include a rack and pinion linear slide mechanism. The telescopic coupling 174 may include an actuator (not shown in the FIGS.), such as an electric, hydraulic, or pneumatic actuator for adjusting the length of the handle arm 150. The actuator may be a linear actuator or a rotary actuator. The telescopic coupling 174 also may include a load cell configured to measure a compression force or a tensile force applied to the handle arm 150.

The handle arm 150 shown in FIGS. 3-4 also includes a third latch 176 configured to selectively lock the telescopic coupling 174 between the first shaft 162 and the second shaft 164. In this way, the length of the handle arm 150 may be held in a desired position after being adjusted. This may be used to adjust the handle arm 150 to a desired positon, which may be adjusted to suit users of different sizes, (e.g. height, width, weight, etc.) and/or to perform different exercises. The handle arm 150 may also be configured and locked into a particular position, such as a shortest length when placing the arm 130 in the retracted position. The third latch 176 may include a switch or slider interface, although other configurations may be used for the third latch 176, such as a pin that engages a hole, a rotary latch, a slider, a cam lock, etc. The third latch 176 may include a mechanism or actuator, such as a hydraulic, magnetic, and/or electric actuator to selectively lock the first shaft 162 and the second shaft 164 when activated. The third latch 176 may include other components or devices (not shown) such as a pawl and ratchet, a clamp, a friction device, a pin, and/or a lock to selectively lock the first shaft 162 and the second shaft 164.

In some embodiments, the distance between the second pivot 152 and the third pivot 170 may be adjusted without changing the length of the handle arm 150, as described above. For example, the third pivot 170 may take the form of a peg that can be installed in any one of several different holes along a length of the handle arm 150.

In some embodiments, the handgrip assembly 126 is configured to be movable relative to the handle arm 150 in a third degree of freedom at the third pivot 170. Specifically, as shown in FIG. 4, the third degree of freedom provides for the handgrip assembly 126 to be rotatable about a third axis A3 extending parallel to and spaced apart from the second axis A2. In other words, the third pivot 170 may allow the handgrip assembly 126 to rotate about the third axis A3. The third pivot 170 may include one or more bearings and/or bushings to provide for the handgrip assembly 126 to be attached to the handle arm 150 while also being rotatable about the third axis A3.

In some embodiments, the handlebar 128 and/or the entire handgrip assembly 126 is configured to be movable relative to the handle arm 150 in a fourth degree of freedom at a fourth pivot 180. Specifically, as shown in FIG. 3, the fourth degree of freedom provides for the handgrip assembly 126 to be rotatable about a fourth axis A4, which extends perpendicularly through the third axis A3. In this way, one or more of the handgrip assemblies 126 may be positioned in a retracted position flat against the arm 130, as shown in FIG. 3, or in an extended position, with the handlebar 128 extending perpendicularly to the arm 130, as shown in FIG. 4. The fourth pivot 180 may provide for the handgrip assembly 126 to be locked or secured in either or both of the retracted and/or the extended positions (or in an intermediate position between the retracted and extended positions).

Embodiments of the first apparatus 100 may also include a monitor support 184 coupled to the arm 130 and configured to support a display screen 186. The display screen 186 may include, for example, a touch screen, a flat-panel monitor, or a television screen. Alternatively, the display screen 186 may be a self-contained unit, which may include a processor and a battery. For example, the display screen 186 may take the form of a tablet computing device, such as an iPad® from Apple, or a tablet running the Android operating system, such as a Galaxy Tab® device from Samsung, or a tablet running the Windows® operating system, such as the Surface® tablet from Microsoft.

The monitor support 184 may be fixed in position upon a part of the first apparatus 100, such as the frame 104 or the arm 130. Alternatively, the monitor support 184 may be movable. For example, the monitor support 184 may be slidable along a linear path 188 extending between the proximal end 132 and the distal end 134 of the arm 130. The linear path 188 may take the form of a track or rail, which may be disposed upon or within a surface of the arm 130. The monitor support 184 may include a base portion 190 which is configured to slide along the linear path 188. The base portion 190 may include an adjustment mechanism, such as a tilting mechanism, that may allow the monitor support 184 to be tilted to one or more different positions relative to the arm 130. The apparatus may also include a fourth latch 192 configured to selectively restrain the monitor support 184 at a fixed location along the linear path 188. The fourth latch 192 may be a part of the base portion 190, as shown. The fourth latch 192 may include a lever-type interface, although other configurations may be used for the fourth latch 192, such as a pin that engages a hole, a rotary latch, a slider, a cam lock, etc. The fourth latch 192 may include a mechanism or actuator, such as a hydraulic, magnetic, and/or electric actuator to selectively restrain the monitor support 184 at a fixed location when activated. The fourth latch 192 may include other components or devices (not shown) such as a pawl and ratchet, a clamp, a friction device, a pin, and/or a lock to selectively restrain the monitor support 184 at a fixed location.

Figure 6:
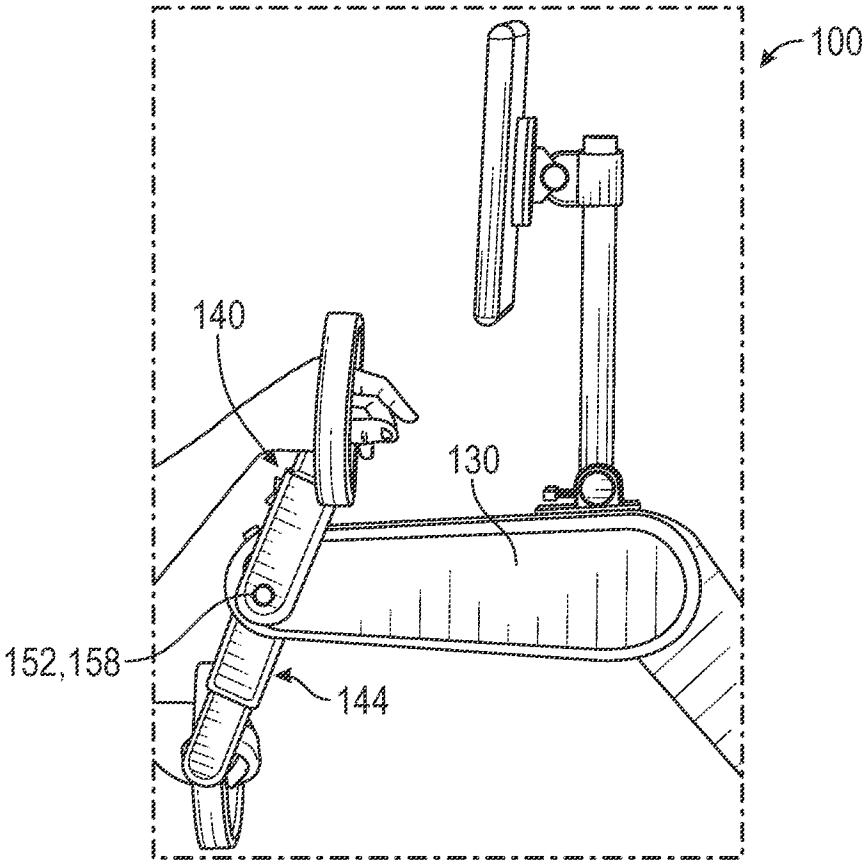
FIG. 6 is a side view of the portion of FIG. 3 with an embodiment of the handles in a hand-crank position.
Figure 5:
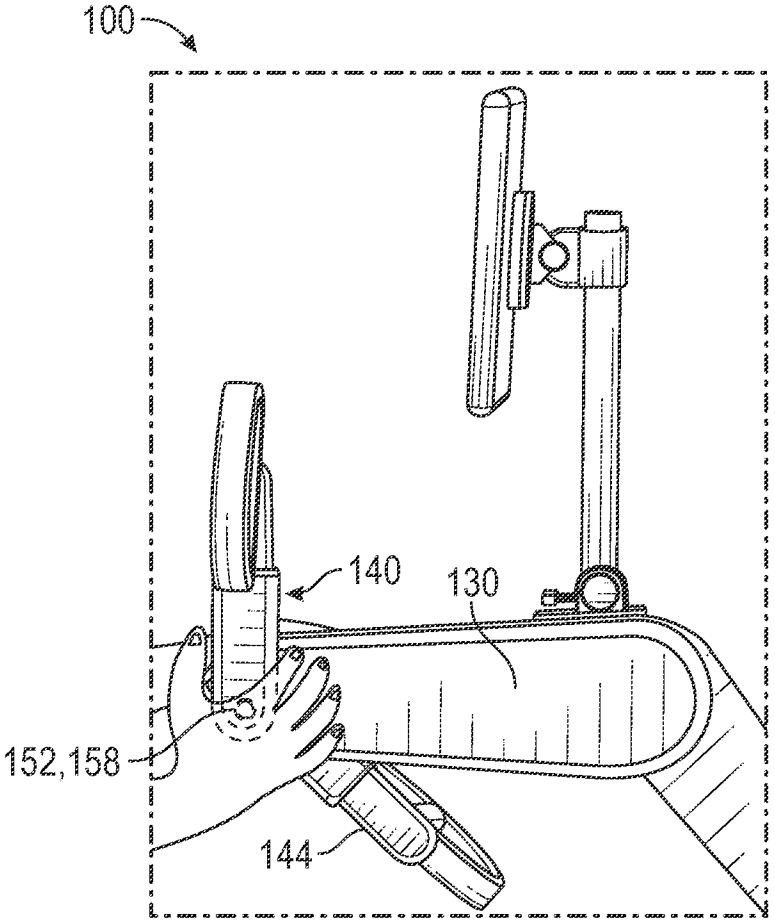
FIG. 5 is a side view of the portion of FIG. 3 with an embodiment of the handle in an intermediate position.

FIG. 5 shows the handles 140, 144, with the left handle 144 at an oblique angle relative to the right handle 140. The handles 140, 144 may each be fixed to the bar 158 at the second pivot 152 in this position and used, for example, to perform a hand-crank exercise by rotating both of the handles 140, 144 about the second pivot. Alternatively, the handles 140, 144 may each be fixed to the bar 158 at the second pivot 152 to perform a one-handed hand-crank exercise, and with the other one of the handles 140, 144 decoupled from the bar 158 at the second pivot 152 and able to remain stationary. FIG. 6 shows the handles 140, 144 extending in opposite directions. The handles 140, 144 may each be fixed to the bar 158 at the second pivot 152 in this position and used, for example, to perform a traditional two-handed hand-crank exercise by rotating both of the handles 140, 144 about the second pivot.

Figure 8:
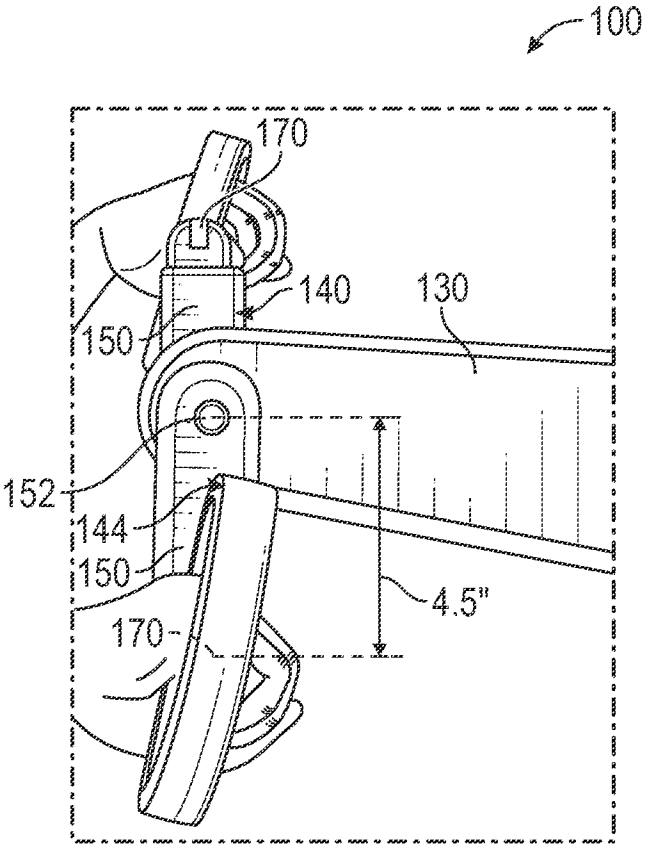
FIG. 8 is a side view of the portion of FIG. 3 with an embodiment of the handles at different lengths.
Figure 7:
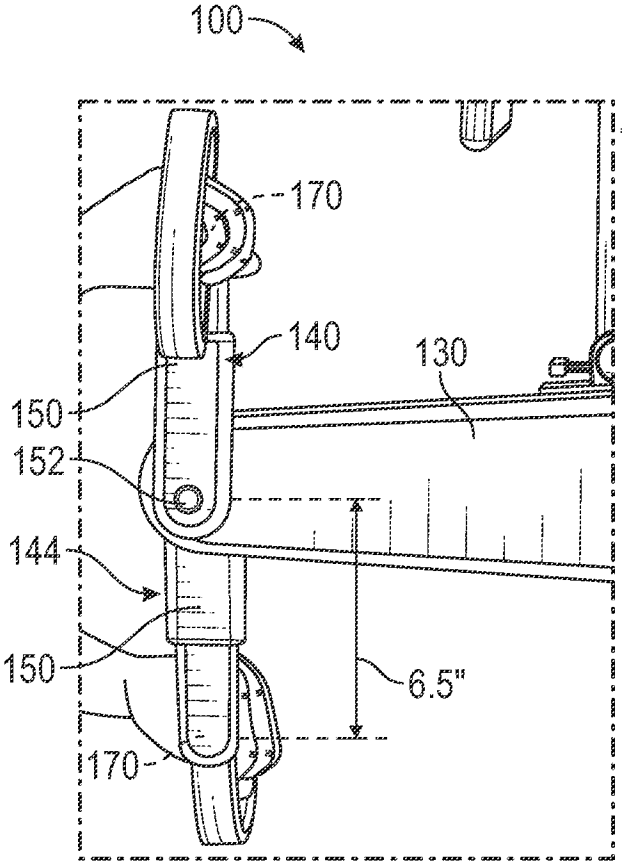
FIG. 7 is a side view of the portion of FIG. 3 with an embodiment of the handles at equal lengths.

FIG. 7 shows the handles 140, 144 with the respective handle arms 150 each in an extended position, in which the distance between the second pivot 152 and the respective one of the third pivots 170 is 6.5 inches. This is merely an example, and the extended position may include the distance between the second pivot 152 and the third pivot 170 being larger than or smaller than 6.5 inches. FIG. 8 shows the handles 140, 144 with the respective handle arms 150 each in a retracted position, in which the distance between the second pivot 152 and the respective one of the third pivots 170 is 4.5 inches. This is merely an example, and the retracted position may include the distance between the second pivot 152 and the third pivot 170 being larger than or smaller than 4.5 inches. Furthermore, the handle arms 150 may be adjusted independently, such that the handle arms 150 have different lengths. A configuration with the handles 140, 144 having different lengths may be useful, for example, in rehabilitating a user's arm or a related body part, such as a shoulder, that has a limited range of motion, and which may be aided by a full range of motion performed by the other arm.

Figure 9:
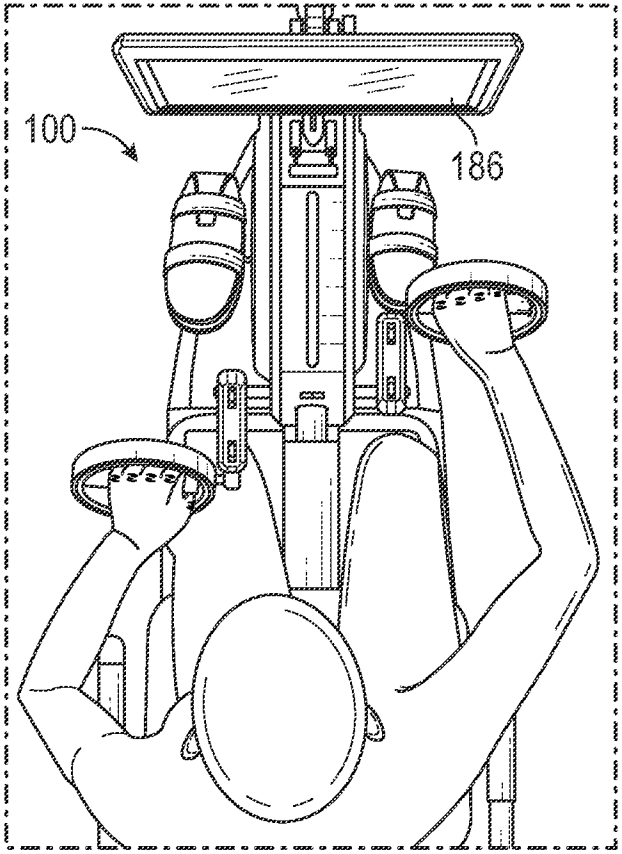
FIG. 9 is a top view of the apparatus of FIG. 1 showing an embodiment of a graphical user interface while the user performs a hand-crank exercise.
Figure 9:
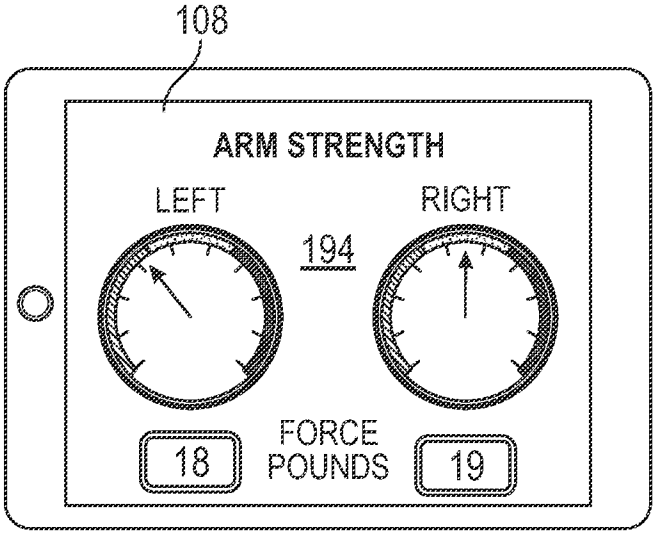

FIG. 9 shows an overhead view of the first apparatus 100 of FIG. 1, together with an example graphic image 194. Specifically, FIG. 9 shows a user performing a hand-crank exercise using the first apparatus 100 while the graphic image 194 shows different forces being measured on each of the left and right handles 140, 144. The example graphic image 194 may be presented on the display screen 186 and/or on another display device, such as a workstation that may be used, for example, by a technician, personal trainer, or physical therapist. Each of the left and right handles 140, 144 may have a load cell operatively attached thereto to measure the force applied to the corresponding one of the handles 140, 144.

Figure 11:
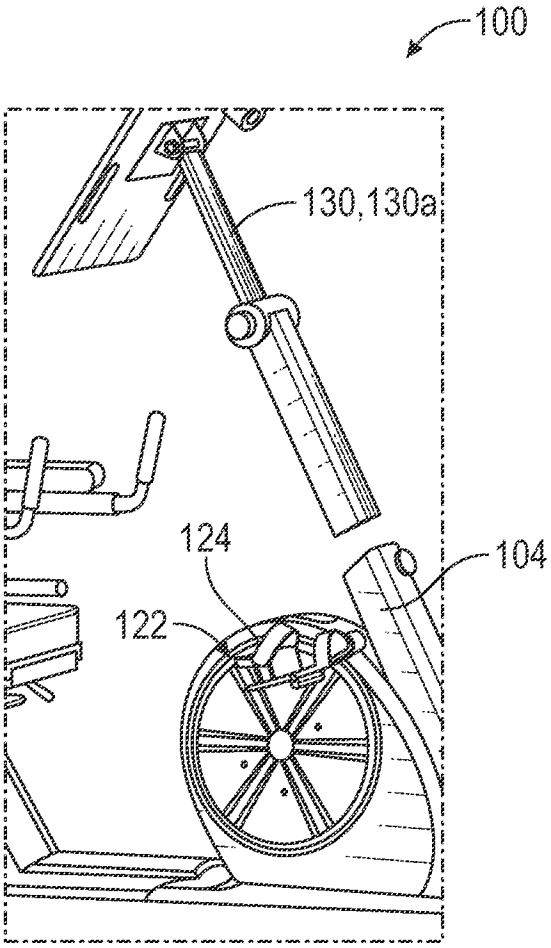
FIG. 11 is a side view of the apparatus of FIG. 10 with an embodiment of the tabletop assembly removed from the frame.
Figure 10:
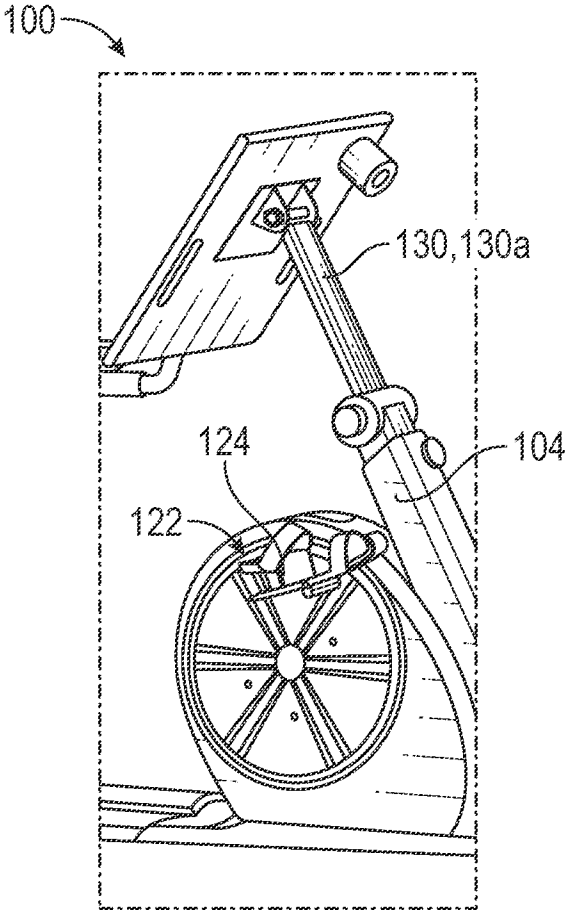
FIG. 10 is a side view of the apparatus of FIG. 1 with an embodiment of a frame supporting a tabletop assembly.
Figure 12:
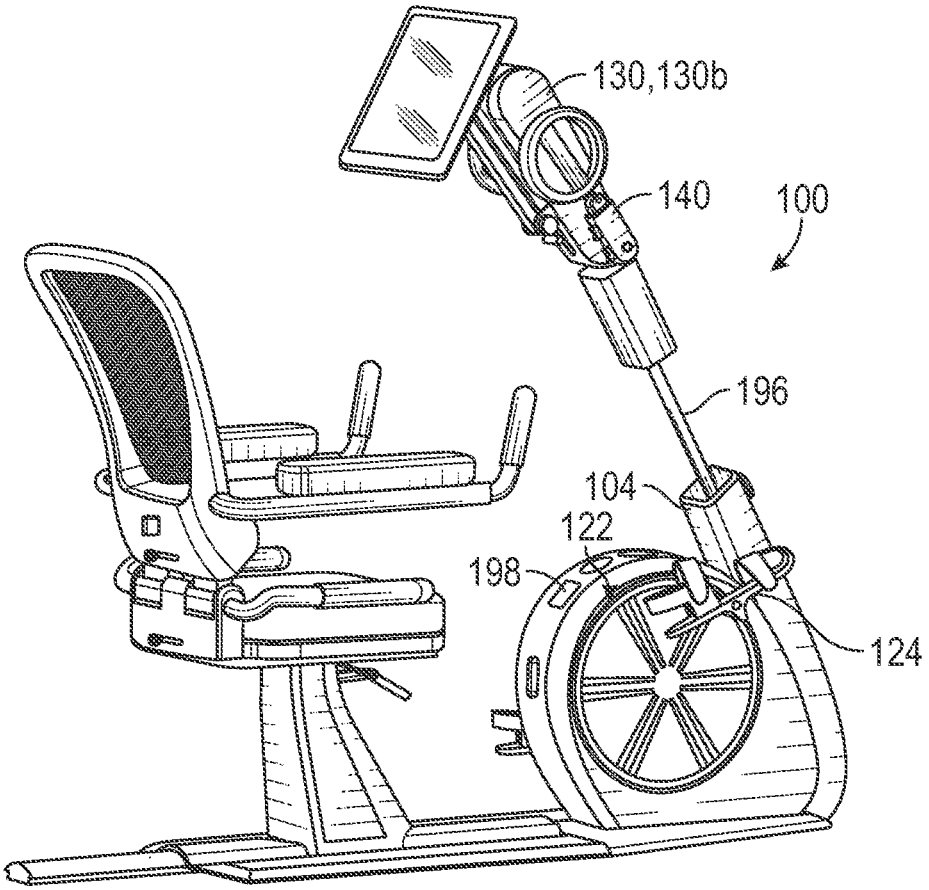
FIG. 12 is a side view of the apparatus of FIG. 10 with an embodiment of a handle assembly above the frame.

In some embodiments, and as shown on FIGS. 10-12, the first apparatus 100 may include two or more different arms 130, which may each be removable from the frame 104. For example, a first arm 130*a* of the arms 130, which may include, for example, a flat table surface, may be removed from the frame 104 and substituted for a second arm 130*b* of the arms 130, which may include, for example, one or more of the handles 140, 144.

In some embodiments the first apparatus 100 may include an actuator (not shown) for moving one or more of the handles 140, 144 relative to the arm 130. For example, the actuator may exert a force to rotate one or more of the handles 140, 144, which may help to assist a user in moving their arms and/or other upper body parts. In some embodiments, and as shown in FIG. 12, the actuator may include a linkage 196 that is rotated by the cycle mechanism 122 and which causes the handles 140, 144 to rotate with the pedals 124. The first apparatus 100 may also include a fifth latch 198 configured to selectively couple the handles 140, 144 to rotate with one or more of the pedals 124.

Figure 13:
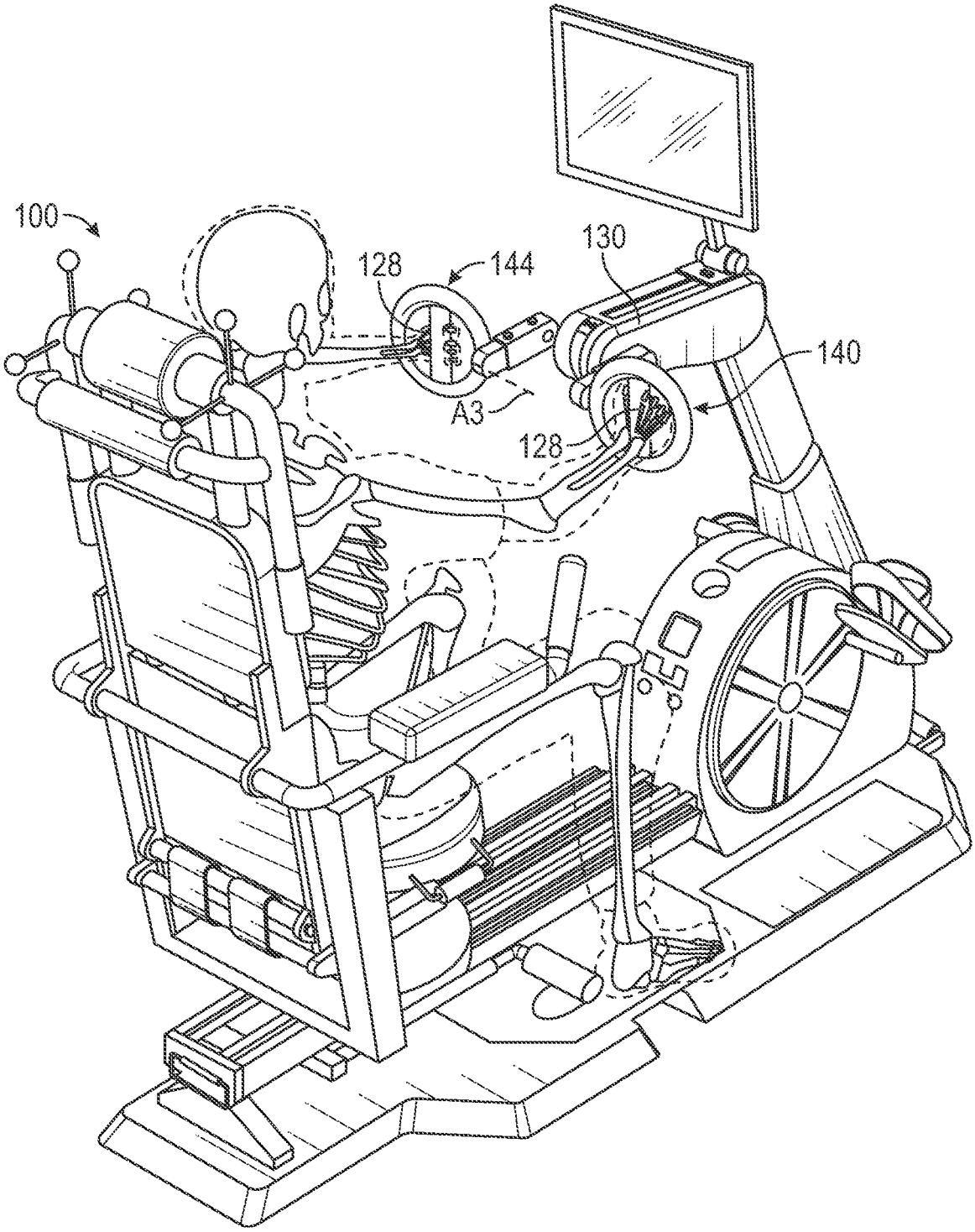
FIG. 13 is an elevated perspective view of an embodiment of the apparatus with the user performing a bench-press exercise.
Figure 14:
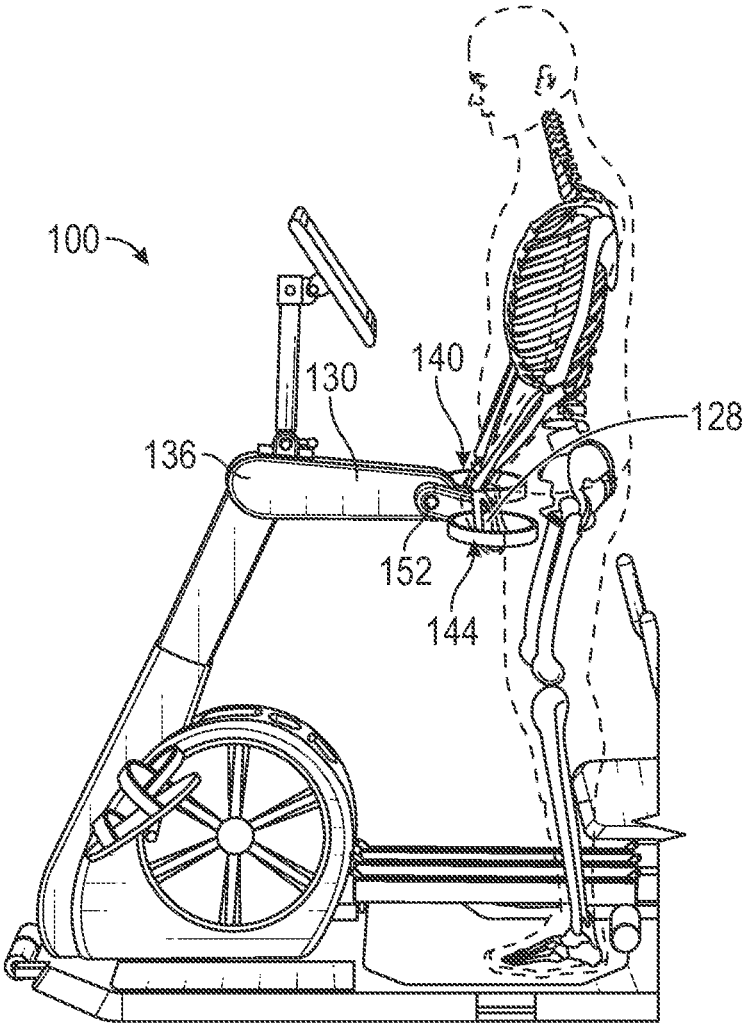
FIG. 14 is a side view of the apparatus of FIG. 13 with the user performing an embodiment of a suitcase-lift exercise.
Figure 15:
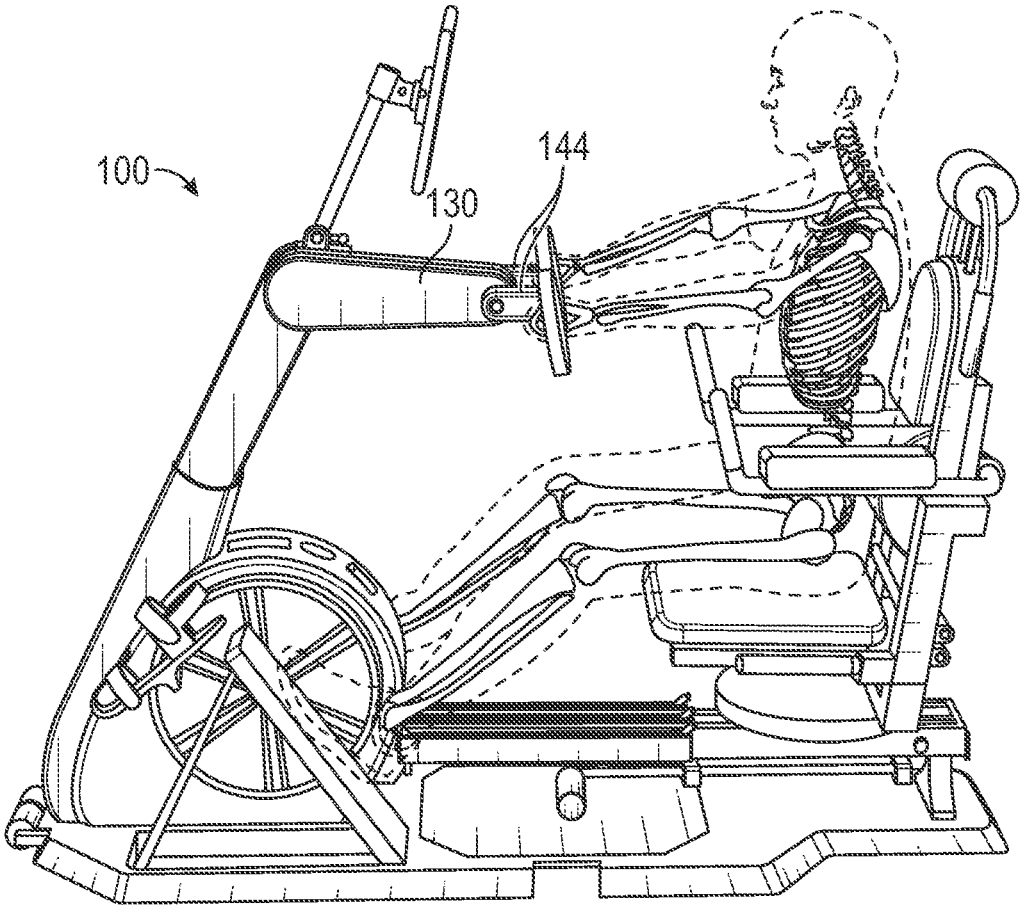
FIG. 15 is a side view of the apparatus of FIG. 13 with the user performing an embodiment of a rowing exercise.

The first apparatus 100 may be used to perform several different isometric exercises, which may be characterized by the application of force and without substantial motion. A few example isometric exercises are shown in FIGS. 13-15. With the first apparatus 100, a user can perform a bench-press exercise. FIG. 13 shows the first apparatus 100 with the handles 140, 144 each extending in a common direction and each fixed to not rotate relative to the arm 130. The handgrip assemblies 126 are each configured with the respective handlebar 128 oriented vertically, which is perpendicular to the third axis A3, which is described above, with reference to FIG. 3. In practice, a user may exert a pushing force on each of the handlebars 128, which may be measured by the first apparatus 100 as a compressive force on the arm 130 or on corresponding ones of the handles 140, 144.

FIG. 14 shows an elevated perspective view of the first apparatus 100 with a user performing a suitcase-lift style exercise. Specifically, FIG. 14 is similar to the configuration of FIG. 13, except each of the handlebars 128 is oriented to be in line with the third axis A3. In practice, a user may exert a pulling force on each of the handlebars 128, which may be measured by the first apparatus 100 as a rotational force (i.e. torque) on one or more of the first pivot 136 and/or the second pivot 152.

FIG. 15 is a side view of the first apparatus 100 with a user performing a rowing exercise. In some embodiments, the arm 130 and the handles 140, 144 may be fixed in a rigid position to support exercises, such as the rowing exercise shown. Alternatively or additionally, the arm 130 and/or the handles 140, 144 may be free to move or able to move within a predetermined range of motion, such as, for example, an elliptical pattern, which may mimic the motion of rowing a boat. In some embodiments, the arm 130 and/or the handles 140, 144 provide a degree of resistance to counter a user's force in moving the handles through a range of motion. The resistance may be adjusted through the range of motion to simulate a realistic rowing operation and/or to provide various exercise intensities.

Figure 16:
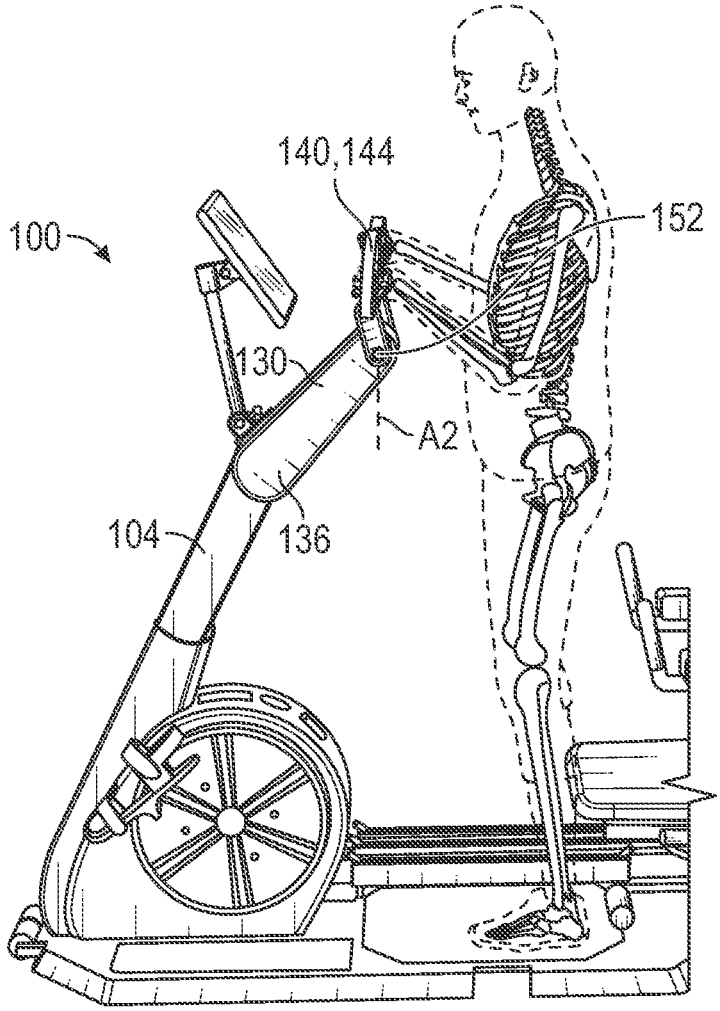
FIG. 16 is a side view of the apparatus of FIG. 13 with the user performing an embodiment of a curl exercise.

FIG. 16 is a side view of the first apparatus 100 with a user performing a curl exercise. Specifically, FIG. 15 shows the arm 130 in an elevated position, nearly in line with the frame 104, and with the handles 140, 144 extending vertically upwardly. Although not shown directly, hands of the user shown on FIG. 16 illustrate the handlebars 128 extending horizontally and parallel to the second axis A2 which extends through the second pivot 152. In practice, a user may exert a pulling force on each of the handlebars 128, which may be measured by the first apparatus 100 as a tension force on the arm 130 or on the respective handles 140, 144 and/or as a rotational force (i.e. torque) on one or more of the first pivot 136 and/or the second pivot 152.

Figure 17:
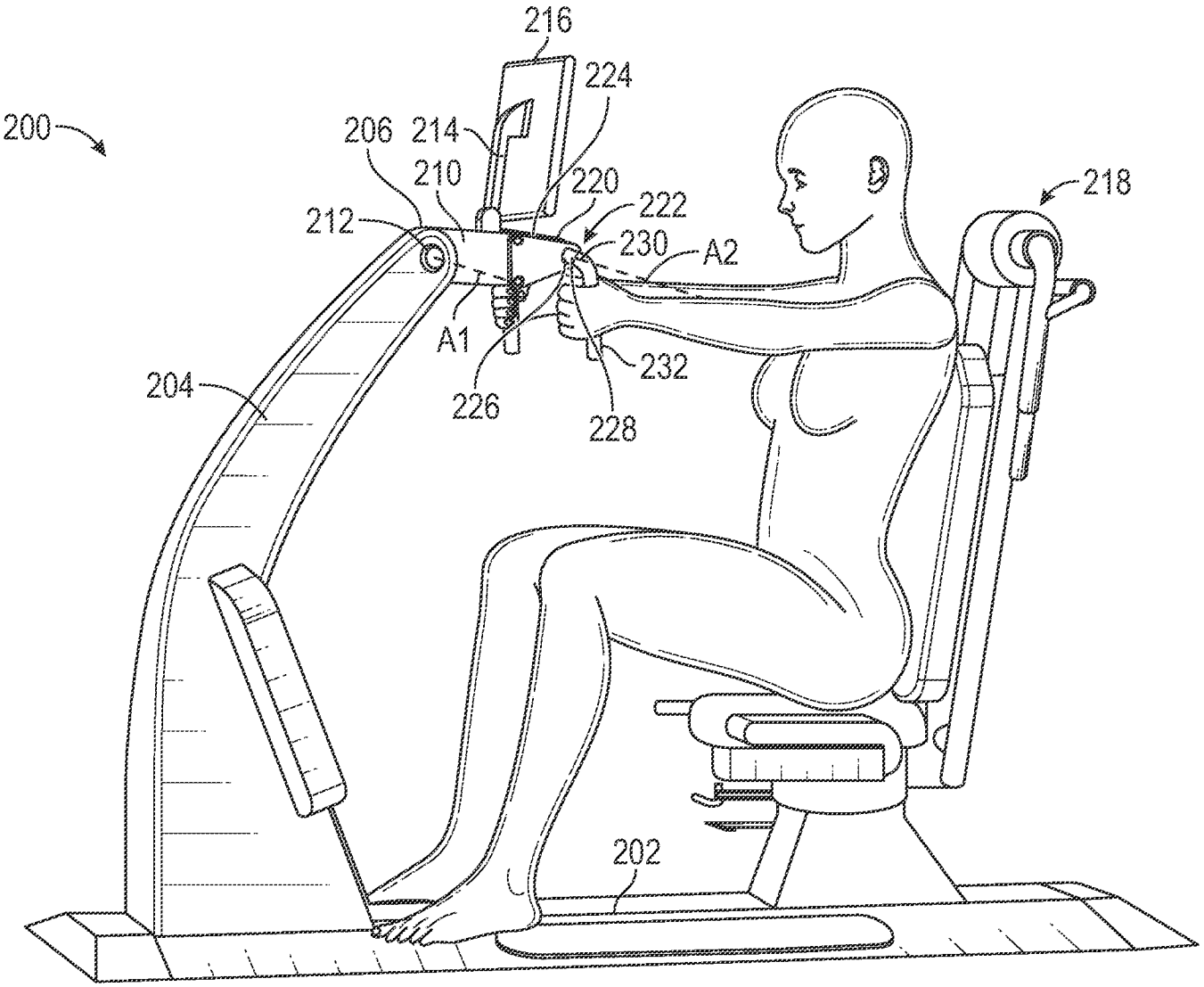
FIG. 17 is a side view of an embodiment of an apparatus with the user performing an embodiment of a bench-press exercise.
Figure 19:
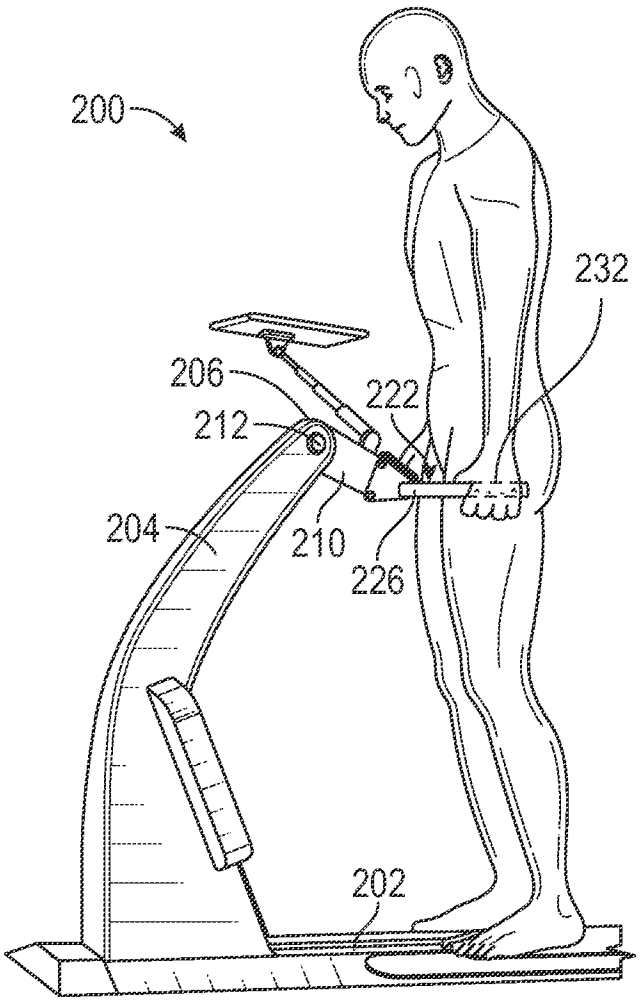
FIG. 19 is a side view of the apparatus of FIG. 17 with the user performing an embodiment of a suitcase-lift exercise.
Figure 18:
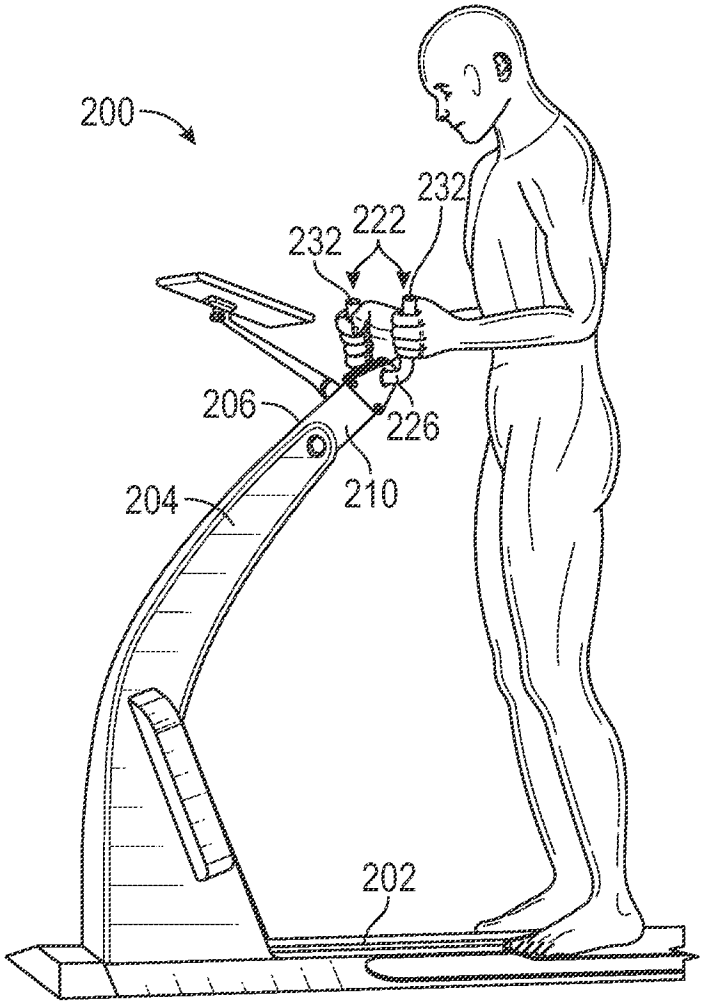
FIG. 18 is a side view of the apparatus of FIG. 17 with the user holding the handles in an embodiment of an upright orientation.

FIGS. 17-19 show the second apparatus 200. FIG. 17 is a perspective view of the second apparatus 200 with a user performing a bench-press exercise. The second apparatus 200 includes a base 202 configured to rest on a ground surface, and a frame 204 coupled to the base 202. The frame 204 defines a top end 206 that is spaced away from the base 202. The frame 204 extends generally transversely or at an oblique angle to the base 202, and may extend generally upwardly with the base 202 resting on the ground surface.

The second apparatus 200 includes an arm 210 coupled to the top end 206 of the frame 204 at a first pivot 212, with the arm 210 rotatable about a first axis A1. The first pivot 212 may include one or more bearings and/or bushings, such as a plain bearing or a ball bearing. The first pivot 212 may include an angle sensor to measure the position of the arm 210 relative to the frame 204. Additionally or alternatively, the first pivot 212 may include a load cell configured to measure a torque between the arm 210 and the frame 204. The arm 210 may also hold a monitor support 214 holding a display screen 216. The monitor support 214 and/or the display screen 216 may be similar to the arrangement described above with reference to the first apparatus 100. The second apparatus 200 may also include a seat 218, which may be similar to the seat 120 described above with reference to the first apparatus 100.

The arm 210 extends from the first pivot 212 to a distal end 220 with a handle 222 extending therefrom. A gusset plate 224 may be fixed on the distal end 220 of the arm 210 to support loads applied to the handle 222. Specifically, a handle 222 extends from each of a right side and a left side of the distal end 220 at a second pivot 226. The second pivot 226 defines a second axis A2, which is parallel to and spaced apart from the first axis A1. In other words, the shaft stubs 228 of each of the handles 222 may be coupled to the arm 210 at the second pivot 226, with the handles 222 movable through a second degree of freedom that includes rotation about the second axis A2. One of the handles 222 may be referred to as a right handle and extend from the right side of the arm 210. Another one of the handles 222 may be referred to as a left handle and extend from the left side of the arm. In some embodiments, the left and right handles may be fixed to rotate together about the second axis A2. In some embodiments, the handgrips 232 of each of the handles 222 may extend generally parallel to one another. In other words, the handgrip 232 of the right one of the handles 222 may extend parallel to and spaced apart from the handgrip 232 of the left one of the handles 222.

The handles 222 may be free to rotate relative to the arm 210 at the first joint. Alternatively, the handles 222 may be fixed to the arm 210 at the first joint to prevent relative motion therebetween. Alternatively yet, the handles 222 may be selectively fixed to the arm 210 at the first joint to either allow or prevent relative motion therebetween. Each of the handles 222 includes a shaft stub 228 extending outwardly from the arm 210. Each of the handles 222 also includes a joint 230 to define a handgrip 232, which is configured to be engaged by the user. The handgrip 232 may extend generally transversely to the shaft stub 228. The handgrip 232 may extend perpendicularly or substantially perpendicularly to the shaft stub 228. Alternatively, the handgrip 232 may extend at an oblique angle to the shaft stub 228. In some embodiments, the handgrip 232 and the shaft stub 228 may be integrally formed from a common piece of material such as tubing or a metal bar. The joint 230 may take the form of a bend in the common piece between the handgrip 232 and the shaft stub 228. In other embodiments, the handgrip 232 and the shaft stub 228 may be formed from separate pieces which may be held together at the joint 230.

FIG. 18 is a perspective view of the second apparatus 200 of FIG. 17 with a user holding the handgrips 232 in an upright orientation. Specifically, FIG. 18 shows the second apparatus 200 with the handgrips 232 each extending in a common direction and each fixed to not rotate relative to the arm 210. The handles 222 are each configured with the respective handgrip 232 oriented vertically upwardly. In practice, a user may exert a pushing force on each of the handgrips 232, which may be measured by the second apparatus 200 as a compressive force on the arm 210 or the frame 204 or as a rotational force (i.e. torque) at the second joint between the handle 222 and the arm 210 or as a tension or compression force within the arm 210 or the frame 204.

FIG. 19 is a perspective view of the second apparatus 200 of FIG. 17 with a user performing a suitcase-lift exercise. Specifically, FIG. 19 is similar to the configuration of FIG. 18, except for the positioning of the arm 210 and the handgrips 232, which extend generally horizontally. In practice, a user may exert a pulling force on each of the handgrips 232, which may be measured by the second apparatus 200 as a rotational force (i.e. torque) on one or more of the first pivot 212 and/or the second pivot 226 or as a tension or compression force within the arm 210 or the frame 204.

Figure 20:
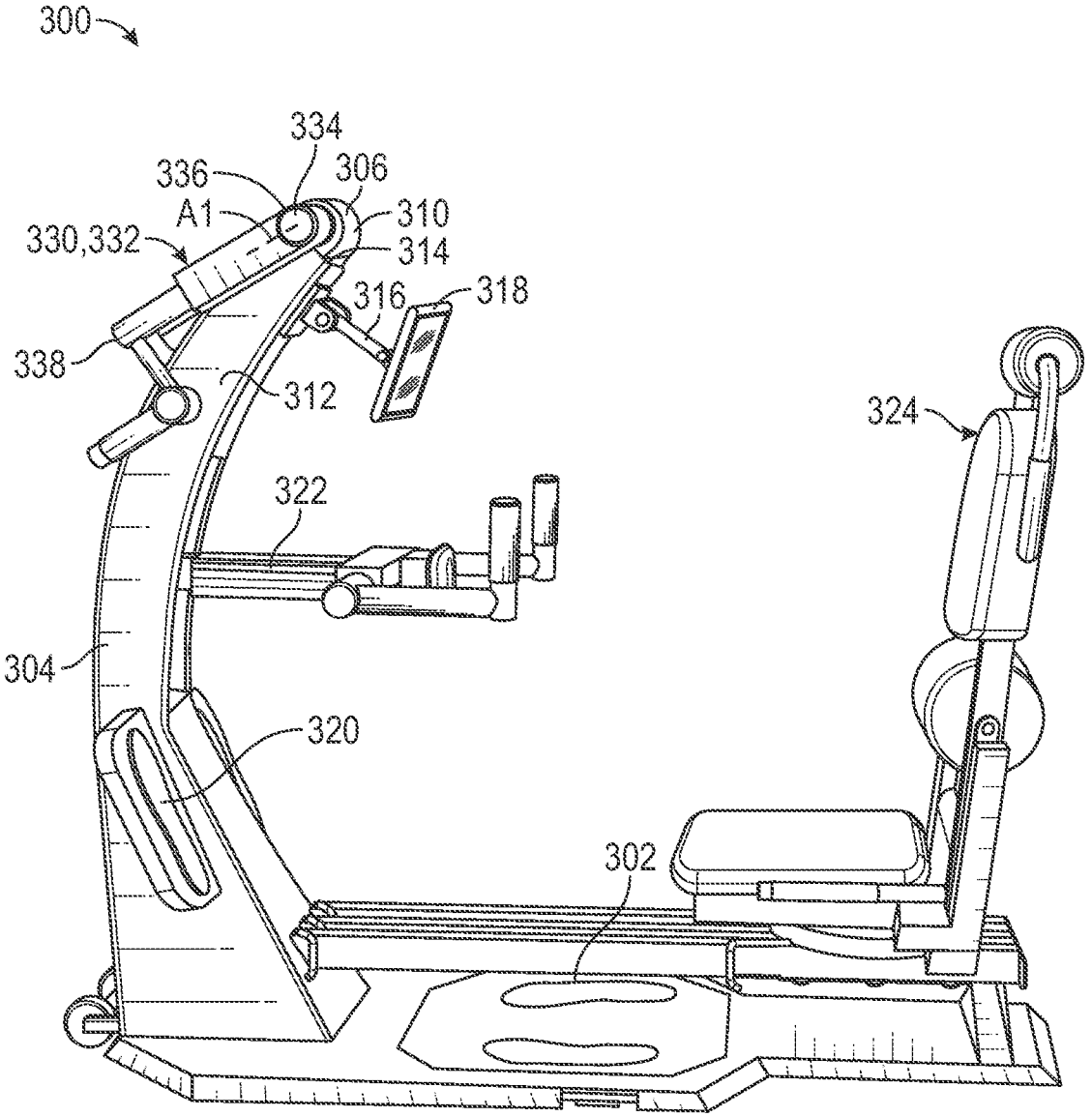
FIG. 20 is a side view of an embodiment of an apparatus with a frame and an arm both in retracted positions.

FIGS. 20-25 show the third apparatus 300. FIG. 20 is a perspective view of the third apparatus 300 with a frame 304 and an arm 330, 332 both in a retracted position. The third apparatus 300 includes a base 302 configured to rest on a ground surface, and a frame 304 coupled to the base 302. The frame 304 defines a top end 306 that is spaced away from the base 302. The frame 304 extends generally transversely or at an oblique angle to the base 302, and may extend generally upwardly with the base 302 resting on the ground surface. The frame 304 of the third apparatus 300 includes an upper member 310 that includes the top end 306, and a lower member 312 holding the upper member 310. A joint 308 couples the upper member 310 to the lower member 312. The joint 308 may be a telescopic joint for adjusting the height of the top end 306. In some embodiments, and as shown in FIG. 20, the upper and lower members 310, 312 may each have an arcuate profile shape. However, one or both of them may have another profile shape, e.g., linear, or non-linear. In some embodiments, the lower member 312 may include a lowest portion of the frame 304 and may be attached to the base 302. Alternatively, the lower member 312 may be spaced apart from the base 302. The lower member 312 may, for example, be supported by another structure that is attached to the base 302.

The frame 304 may hold a monitor support 316 holding a display screen 318. The monitor support 316 and/or the display screen 318 may be similar to the arrangement described above with reference to the first apparatus 100. The frame 304 may support one or more foot plates 320 for a user's foot to engage. For example, a user may push-off with their foot against one or more of the foot plates 320. The frame 304 may support other equipment and/or controls, such as an exercise bar 322 which may be engaged by the user to perform one or more different exercises. The third apparatus 300 may also include a seat 324, which may be similar to the seat 120 described above with reference to the first apparatus 100.

The second apparatus 200 includes a left arm 330 coupled to a left side of the frame 304 and a right arm 332 coupled to a right side of the frame 304, opposite the left side. Each of the arms 330, 332 defines a proximal end 336 coupled to the top end 306 of the frame 304 at a first pivot 334, and is rotatable about a first axis A1. The first pivot 334 may include one or more bearings and/or bushings, such as a plain bearing or a ball bearing. The first pivot 334 may include an angle sensor to measure the position of one or more of the arms 330, 332 relative to the frame 304. Additionally or alternatively, the first pivot 334 may include a load cell configured to measure a torque between one or more of the arms 330, 332 and the frame 304. Each of the arms 330, 332 also defines a distal end 338 end opposite the proximal end 336.

Figure 21:
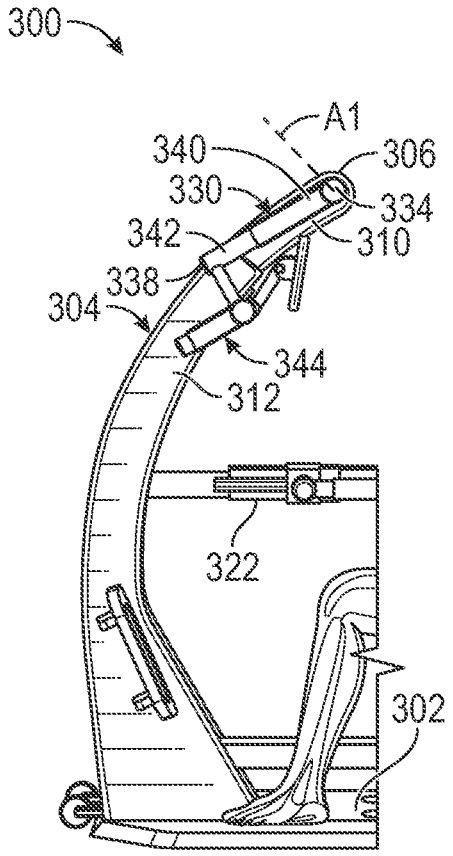
FIG. 21 is a side view of the apparatus of FIG. 20 with an embodiment of the frame in an extended position and the arm is in the retracted position.

FIG. 21 is a perspective view of the second apparatus 200 with the frame 304 in an extended position, and with the arms 330, 332 in a retracted position. Specifically, the upper member 310 of the frame 304 is extended outwardly from the lower member 312, thereby spacing the top end 306 away from the base 302, when compared with the retracted position shown in FIG. 20.

Figure 22:
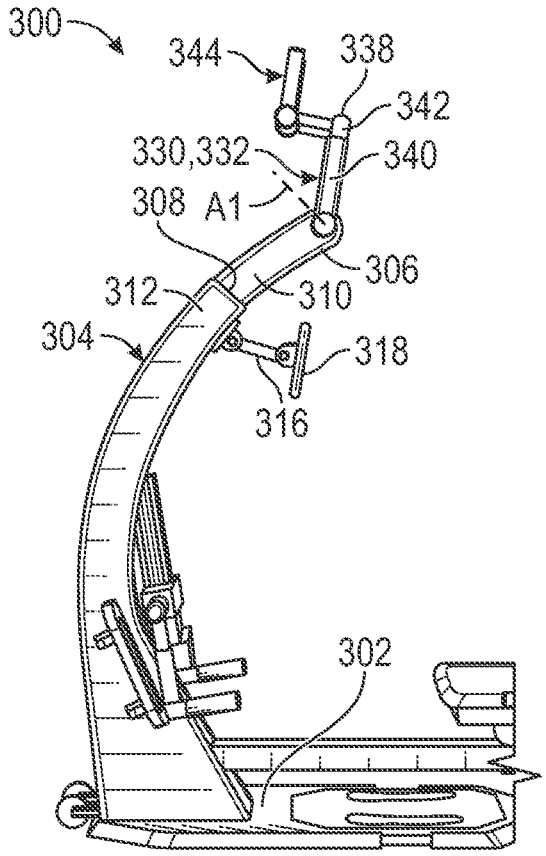
FIG. 22 is a side view of the apparatus of FIG. 20 with an embodiment of the frame in the extended position and the arm in an intermediate position.

For ease of description, the parts of the arms 330, 332 are described and shown with reference to the left arm 330, which is shown in FIG. 22, but each of the arms 330, 332 may have a similar, identical, or mirror-image construction. The left arm 330 includes an inner shaft 340 coupled to the top end 306 of the frame 304, an outer shaft 342 defining the distal end 338, which is located opposite (i.e. spaced away from) the inner shaft 340. The distal end 338 of the left arm 330 is coupled to and supports a handle 344. The left arm 330 also includes a telescopic coupling 348 between the inner shaft 340 and the outer shaft 342. The telescopic coupling 348 is configured to adjust a length of the left arm 330 between the top end 306 of the frame 304 and the handle 344. It should be appreciated that the telescopic coupling 348 is an illustrative example, and that the length of the left arm 330 may be adjusted using other configurations or mechanisms. The telescopic coupling 348 may include a load cell configured to measure a force, such as a compression force or a tensile force, applied to the left arm 330.

Figure 23:
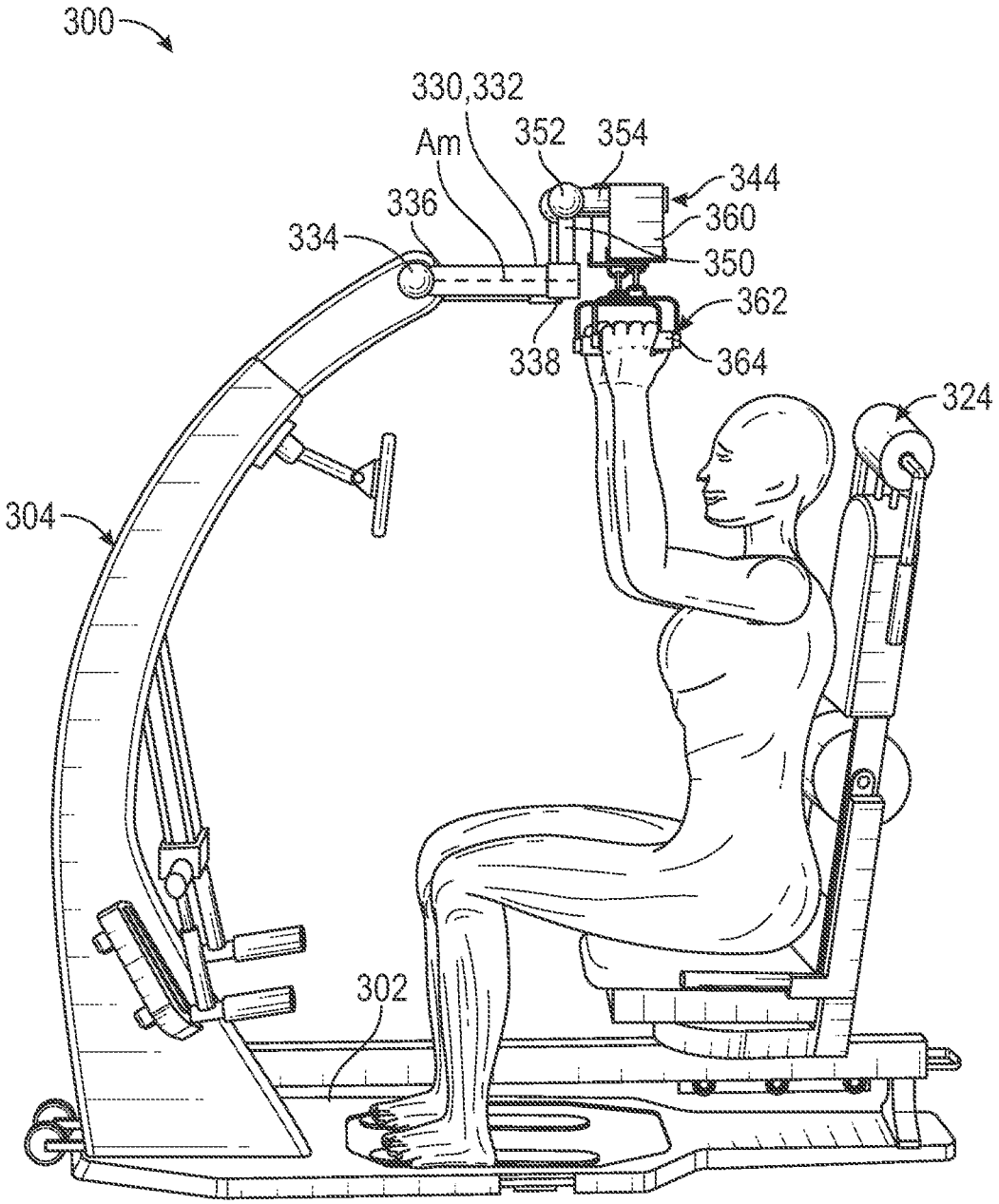
FIG. 23 is a side view of the apparatus of FIG. 20 with an embodiment of a handle in an upright position.

FIG. 22 shows a perspective view of the third apparatus 300, with the frame 304 in an extended position and with the arms 330, 332 in an intermediate position. Specifically, the arms 330, 332 are rotated about the first axis A1 at the first pivot 334 to extend upwardly, and away from the base 302. FIG. 23 shows a perspective view of the second apparatus 200, with the frame 304 in an extended position and with the arms 330, 332 in an extended position. Specifically, the arms 330, 332 are further rotated about the first axis A1 at the first pivot 334 from the intermediate position shown in FIG. 22 to horizontally and parallel to the base. The handles 344 may be in a position for use to perform one or more exercises with the arms 330, 332 in the extended position.

As shown in FIG. 23, each of the arms 330, 332 defines a major axis Am that extends along a length of the associated one of the arms 330, 332 between the proximal end 336 and the distal end 338. Each of the handles 344 includes a first beam 350 extending from the distal end 338 of the associated one of the arms 330, 332 to a handle joint 352 which is spaced apart from the associated one of the arms 330, 332. Specifically, the first beam 350 extends perpendicular to the major axis Am of the associated one of the arms 330, 332. The first beam 350 may extend substantially perpendicular to, generally perpendicular to, or at an oblique angle to the major axis Am. Each of the handles 344 also includes a second beam 354, which extends from the handle joint 352. Specifically, the second beam 354 extends parallel to and spaced apart from the major axis Am of the associated one of the arms 330, 332.

Each of the handles 344 is configured to be movable in a second degree of freedom relative to the associated one of the arms 330, 332. For example, one or both of the handles 344 may be configured to rotate about the associated one of the arms 330, 332, such that the second degree of freedom comprises rotation of the handles 344 about the major axis Am of the associated one of the arms 330, 332. This can be seen, for example, in the different positions of the handles 344 between FIG. 23 and FIG. 24. The arms 330, 332 may include a resistance, such as a spring, that may oppose a force by a user causing the handles 344 to rotate about the associated one of the arms 330, 332. The arms 330, 332 may include sensors configured to measure a position of the handles 344 and/or a rotational force (i.e. torque) applied by the handles 344. In some embodiments, the first beam 350 of the handles 344 may be fixed to a corresponding one of the outer shafts 342, causing the outer shaft 342 to rotate with the handle 344 about the major axis Am.

Alternatively or additionally, the handle joint 352 may define a second pivot, which may allow the second beam 354 to move relative to the first beam 350, such that the second degree of freedom includes movement of the second beam 354 relative to the associated one of the arms 330, 332.

Figure 24:
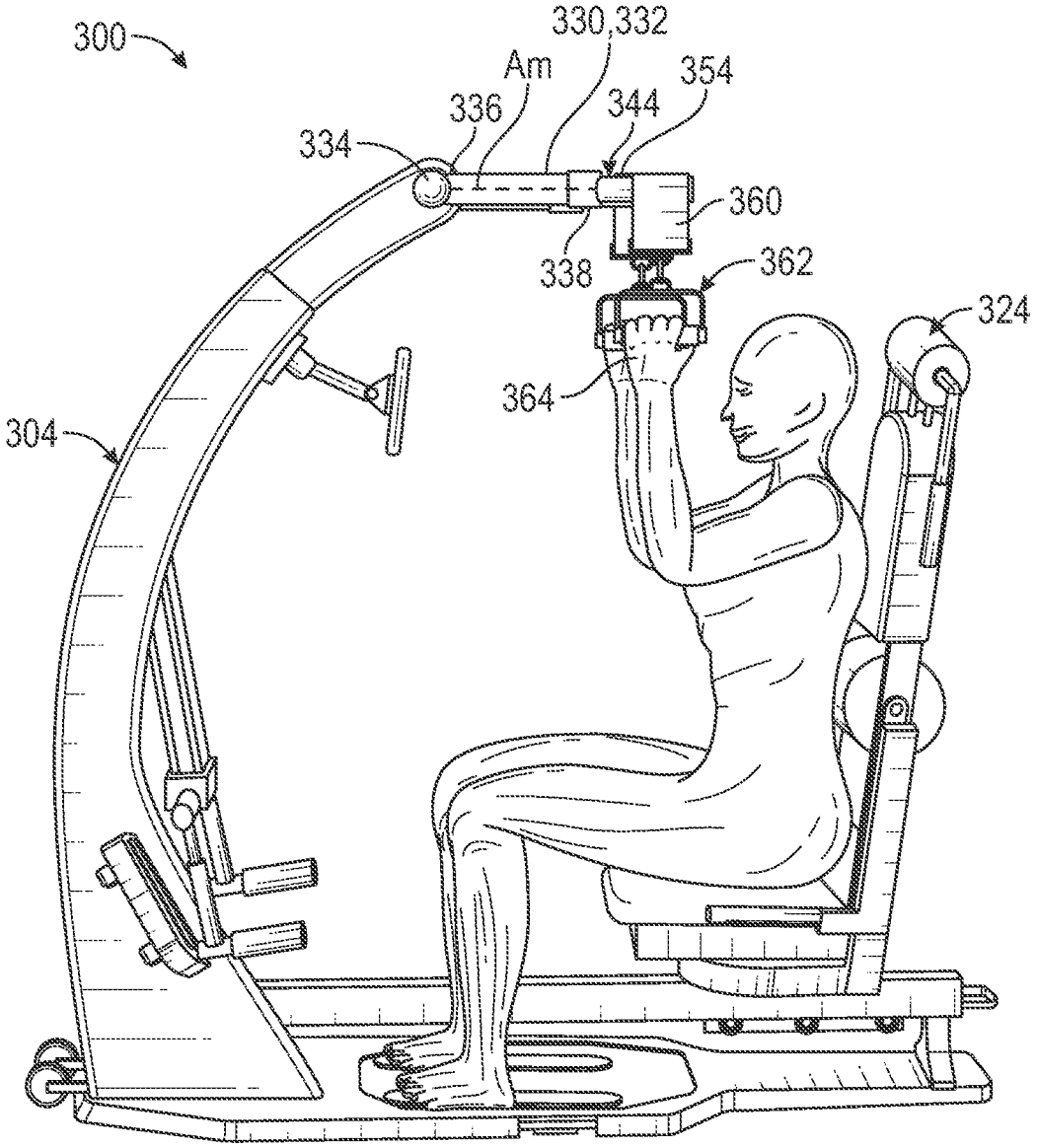
FIG. 24 is a side view of the apparatus of FIG. 20 with an embodiment of the handle in an outward position.
Figure 25:
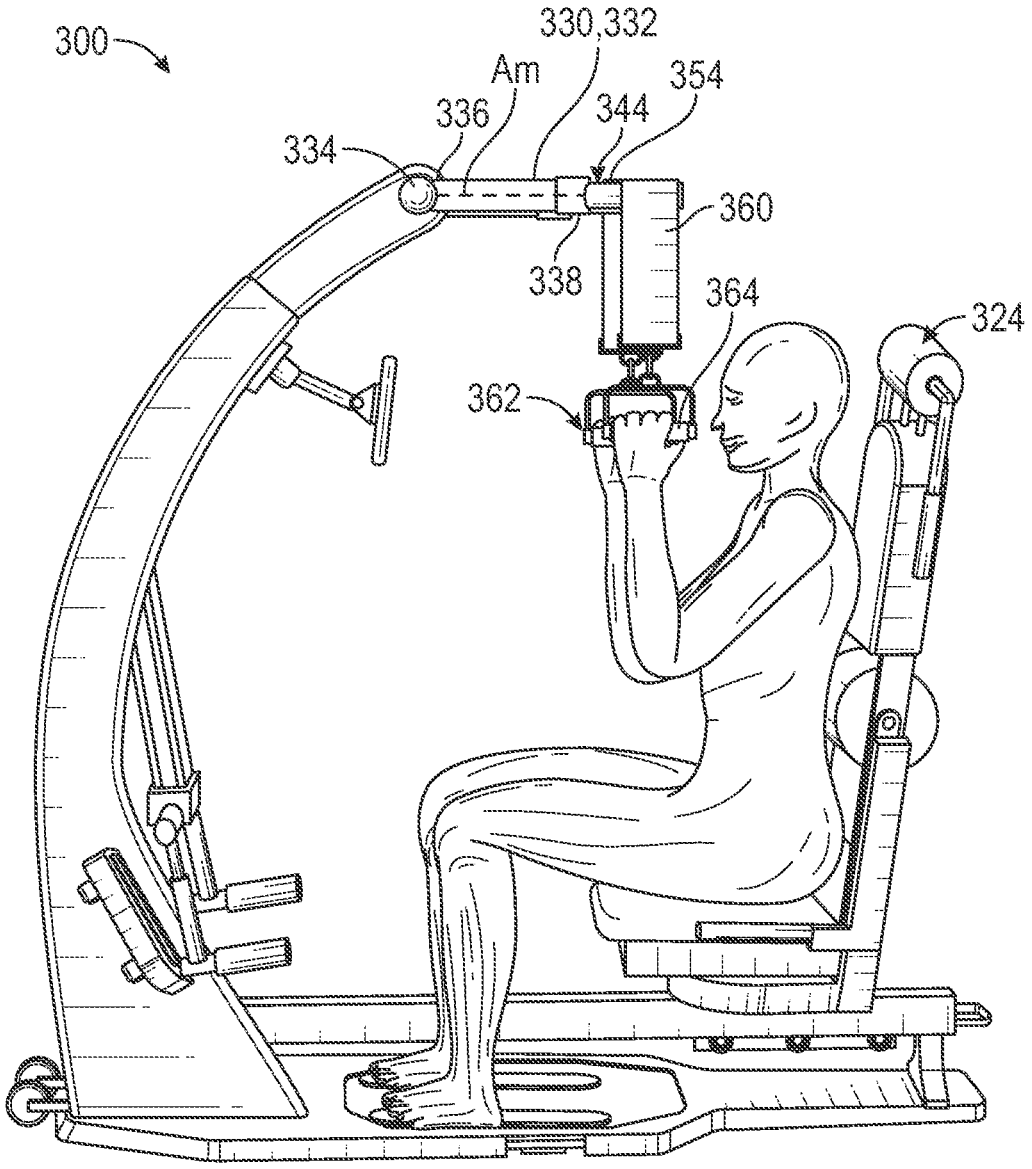
FIG. 25 is a side view of the apparatus of FIG. 20 with an embodiment of a strap in a stretched condition.

In some embodiments, and as shown in FIGS. 23-25, the third apparatus 300 includes a strap 360 disposed around the second beam 354 of one or both of the handles 344. The strap 360 extends to a handgrip assembly 362 that is configured to be grasped by the user for exerting a pulling force upon the handle 344. The handgrip assembly 362 includes a handlebar 364, which is configured to be grasped by a hand of the user. The handgrip assembly may include other components, such as mechanical linkages and/or fasteners, to couple the handlebar 364 to a corresponding end of the strap 360

In some embodiments, the strap 360 may be of an elastic material configured to stretch in response to the pulling force. Use of such an elastic strap 360 is shown in the different positions between FIG. 24 and FIG. 25.

Figure 26:
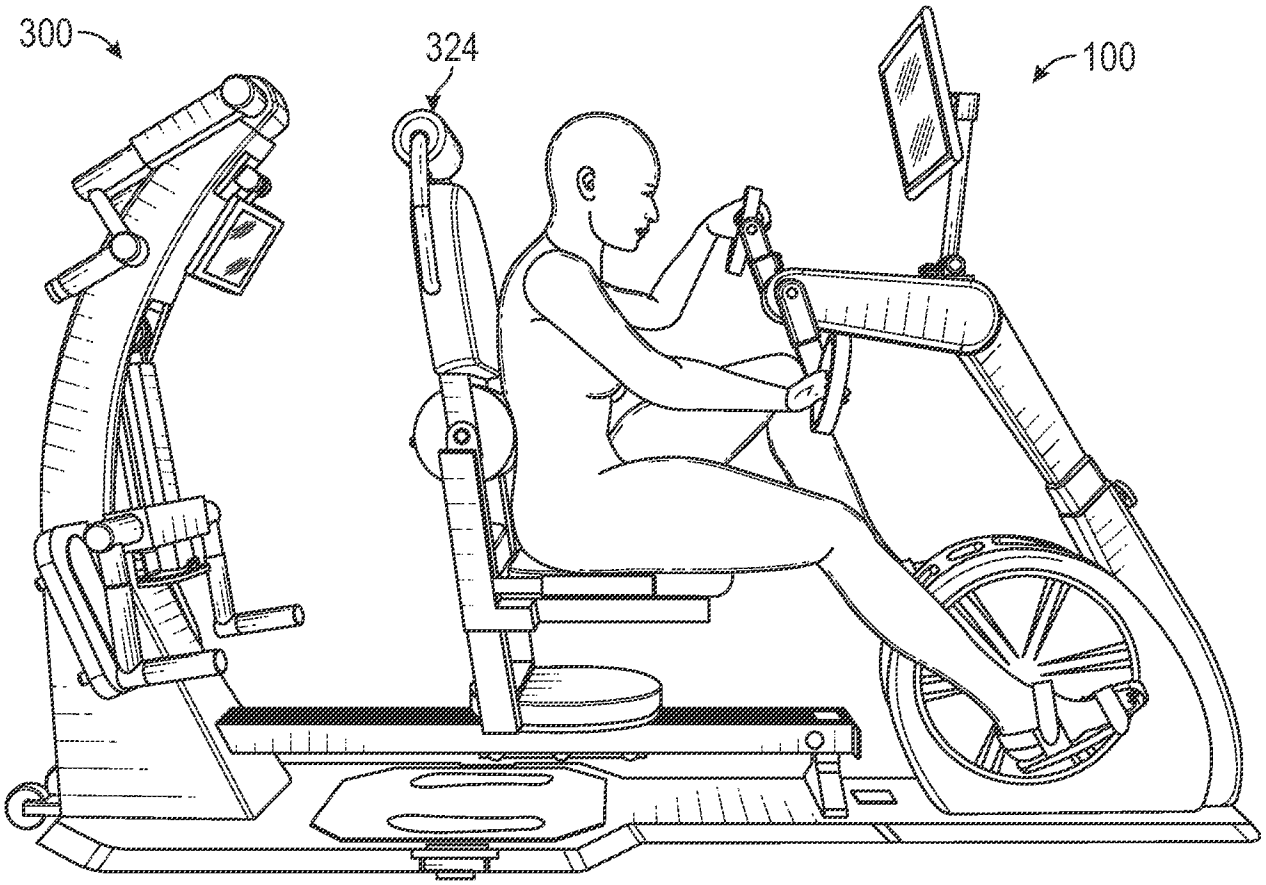
FIG. 26 is a side view of another embodiment of an apparatus in operation.

FIG. 26 shows a perspective view of an exercise and rehabilitation machine that incorporates both the first apparatus 100 and the third apparatus 300, with a seat 324. The seat 324 may be rotated to allow the user to interact with either of the apparatuses 100, 300. It should be appreciated a machine could incorporate a different combination of the first apparatus 100, the second apparatus 200, and/or the third apparatus 300 up to, and including all three of the disclosed apparatuses 100, 200, 300.

Furthermore, supplemental braces or support members may be added to any or all of the example embodiments 100, 200, 300 to counter loads that may be applied to the apparatus in various configurations and/or for performing various exercises. A supplemental brace may also provide additional structural rigidity. Such an additional brace may be removable. For example, a supplemental brace may be snapped into place between the arm 210 and the frame 204. The supplemental brace may support the arm 210 in a given position when performing certain exercises, such as a bench-press or a suitcase-lift exercise.

The apparatus 100, 200, 300, which may take any of the forms disclosed herein, or combinations or variations thereof, may comprise one or more load cells coupled to one or more of the handles 140, 144, 222, 344 for measuring a force applied thereto. In some embodiments, one or more of the load cells may be configured to measure a longitudinal force that is applied parallel to a major axis Am extending along the arm 130, 210, 330, 332 and between a proximal end and a distal end thereof. Such a configuration may be used, for example, for measuring compressive forces applied in a bench-press exercise as shown, for example, in FIG. 13. In some embodiments, one or more load cells may be configured to measure a torsional force that is applied perpendicularly to a major axis Am extending along the arm 130, 210, 330, 332 and between a proximal end and a distal end thereof. Such a configuration may be used, for example, for measuring torsional forces applied in a suitcase-lift exercise as shown, for example, in FIG. 14.

In some embodiments, one or more load cells may include a strain gauge. The strain gauge may include, for example, an axial-type strain gauge, a bending-type strain gauge, a shear-type strain gauge, a torsional-type strain gauge, a double-bending-type strain gauge, a half-bridge-type strain gauge, an S-type strain gauge, and/or a button-type strain gauge. In some embodiments, one or more of the load cells may comprise a piezoelectric load cell. In some embodiments, one or more of the load cells may comprise a hydraulic load cell. These are merely examples, and different types of load cells may be used to measure forces applied to various parts of the apparatus 100, 200, 300.

In some embodiments, a balance board may be communicatively coupled to the control system. For example, the balance board may include a network interface that communicates with the control system via any suitable interface protocol (e.g., Bluetooth, WiFi, cellular). The balance board may include pressure sensors and may obtain measurements of locations and amount of pressure applied to the balance board. The measurements may be transmitted to the control system. The control system may present a game or interactive exercise on a user interface. The game or interactive exercise may modify screens or adjust graphics that are displayed based on the measurements received from the balance board. The balance board may be used by a user to perform any suitable type of plank (e.g., knee plank, regular feet and elbow plank, table plank with elbows, or the like). Accordingly, the balance board may be configured to be used with arms on the balance board, knees on the balance board, and/or feet standing on the balance board. The games or interactive exercises may encourage the user during the game or interactive exercises to increase compliance and neuro-motor control after a surgery, for example.

The exercise machine may be used for various reasons in various markets. For example, users may use the exercise machine in the orthopedic market if the users suffer from chronic musculosketal pain (e.g., knees, hips, shoulders, and back). The exercise machine may be used to help with prehabilitation (prehab), as well as optimize post-surgical outcomes. Users may use the exercise machine in the back and neck pain market if the users suffer with chronic back and neck pain and they want to avoid surgery and experience long-term relief, as well as users that are in recovery following surgery. Users may use the exercise machine in the cardiovascular market if they desire to prevent or recover from life-threatening cardiovascular disease, especially heart attacks and stroke. Users may use the exercise machine in the neurological market if they desire to recover from stroke, or have conditions like Parkinson's Disease and/or Multiple Sclerosis, and the users desire to achieve better balance, strength, and muscle symmetry in order to slow progression of the medical condition.

Embodiments also can include one or more of the following items.

1. An exercise and rehabilitation apparatus, comprising:
a base;
a frame coupled to the base and having a top end;
an arm having a proximal end coupled to the top end of the frame, and a distal end opposite the proximal end, the arm is configured to be movable in a first degree of freedom between a retracted position and an extended position relative to the frame;
a handle coupled to the arm adjacent the distal end, wherein the handle is configured to be movable in a second degree of freedom relative to the arm, and the handle is configured to be manipulated by a user of the exercise and rehabilitation apparatus.

2. The apparatus, wherein the handle comprises a right handle disposed on a right side of the arm and a left handle disposed on a left side of the arm opposite the right side.

3. The apparatus, wherein the frame is fixed to the base to prevent the frame from moving relative to the base.

4. The apparatus, wherein the arm is parallel to the base in the extended position.

5. The apparatus, wherein, in the retracted position, the arm is parallel to the frame.

6. The apparatus, wherein, in the extended position, the arm is transverse to the frame.

7. The apparatus, further comprising a first latch configured to selectively hold the arm at a given position relative to the frame.

8. The apparatus, wherein the arm is coupled to the top end of the frame at a first pivot, and the first degree of freedom comprises rotation about a first axis of the first pivot.

9. The apparatus, wherein the handle comprises a handle arm coupled to the arm at a second pivot, and the handle arm extends from the second pivot and has a far end; and wherein the second degree of freedom comprises rotation about a second axis of the second pivot, and the second axis is parallel to and spaced apart from the first axis.

10. The apparatus, wherein the second pivot comprises a bar extending along the second axis; and further comprising: a second latch configured to selectively couple the handle arm to rotate with the bar.

11. The apparatus, wherein the handle comprises a handgrip assembly coupled to the far end of the handle arm.

12. The apparatus, wherein the handgrip assembly is configured to be movable relative to the handle arm in a third degree of freedom at a third pivot, such that the handgrip assembly is rotatable about a third axis extending parallel to and spaced apart from the second axis.

13. The apparatus, wherein the handgrip assembly is movable relative to the second pivot to adjust a distance between the second pivot and the third pivot.

14. The apparatus, wherein the handle arm comprises a first shaft coupled directly to the arm at the second pivot, a second shaft coupled to the handgrip assembly at the third pivot, and a telescopic coupling between the first shaft and the second shaft to adjust the distance between the second pivot and the third pivot.

15. The apparatus, wherein the handle arm comprises a third latch configured to selectively lock the telescopic coupling between the first shaft and the second shaft.

16. The apparatus, wherein the handgrip assembly comprises a handlebar configured to be grasped by the user.

17. The apparatus, wherein the handlebar is configured to be movable relative to the handle arm in a fourth degree of freedom at a fourth pivot, such that the handlebar is rotatable about a fourth axis extending perpendicular to the third axis.

18. The apparatus, wherein the arm is removable from the frame.

19. The apparatus, further comprising a monitor support coupled to the arm and configured to support a display screen.

20. The apparatus, wherein the monitor support is slidable along a linear path extending between the proximal and distal ends of the arm.

21. The apparatus, further comprising a fourth latch configured to selectively restrain the monitor support at a fixed location along the linear path.

22. The apparatus, further comprising an actuator for moving the handle relative to the arm.

23. The apparatus, wherein the actuator comprises a linkage for coupling the handle to rotate with a pedal.

24. The apparatus, further comprising a fifth latch configured to selectively couple the handle to rotate with a pedal.

25. The apparatus, wherein the handle comprises a shaft stub extending outwardly from the arm, the handle comprises a bend to define a handgrip extending generally transversely to the shaft stub, and the handgrip is configured to be engaged by the user.

26. The apparatus, wherein the left and right handles comprise respective shaft stubs extending away from the arm, each handle comprises a bend to define a respective handgrip extending generally transversely to the respective shaft stub, and the handgrips are configured to be engaged by the user.

27. The apparatus, wherein each of the left shaft stub and the right shaft stub is coupled to the arm at a second pivot; wherein the second degree of freedom comprises rotation about a second axis of the second pivot, and the second axis is parallel to and spaced apart from the first axis; and wherein the left handle is fixed to rotate together with the right handle about the second axis.

28. The apparatus, wherein the left handgrip extends generally parallel to the right handgrip.

29. The apparatus, further comprising a seat coupled to the base and spaced from the frame, wherein the seat is configured to support the user.

30. The apparatus, wherein the arm further comprises:

a left arm coupled to a left side of the frame; and a right arm coupled to a right side of the frame opposite the left side.

31. The apparatus, further comprising a telescopic joint within the frame for adjusting the distance between the base and the top end of the frame.

32. The apparatus, wherein the arm comprises an inner shaft coupled to the top end of the frame, an outer shaft coupled to the handle at the distal end, a telescopic coupling between the inner shaft and the outer shaft, and the telescopic coupling is configured to adjust a length of the arm between the top end of the frame and the handle.

33. The apparatus, wherein the arm defines a major axis extending between the proximal end and the distal end;

wherein the handle comprises: a first beam extending from the distal end of the arm to a handle joint spaced apart from the arm, and a second beam extending from the handle joint; wherein the first beam extends perpendicular to the major axis of the arm; and wherein the second beam extends parallel to and spaced apart from the major axis of the arm.

34. The apparatus, wherein the second degree of freedom comprises rotation about the major axis of the arm.

35. The apparatus, further comprising a strap disposed around the second beam, wherein the strap extends to a handgrip assembly that is configured to be grasped by the user for exerting a pulling force upon the handle.

36. The apparatus, wherein the strap is made of an elastic material that is configured to stretch in response to the pulling force.

37. The apparatus, further comprising a load cell coupled to the handle for measuring a force applied thereto.

38. The apparatus, wherein the load cell is configured to measure a longitudinal force that is applied parallel to a major axis extending between the proximal end and the distal end of the arm.

39. The apparatus, wherein the load cell is configured to measure a torsional force that is applied perpendicularly to a major axis extending between the proximal end and the distal end of the arm.

40. The apparatus, wherein the handle comprises a right handle disposed on a right side of the arm and a left handle disposed on a left side of the arm opposite the right side; and wherein the load cell comprises a right load cell configured to measure a force applied to the right handle, and a left load cell configured to measure a force applied to the left handle.

41. The apparatus, wherein the load cell comprises a strain gauge.

42. The apparatus, wherein the strain gauge is selected from a group comprising: an axial-type strain gauge, a bending-type strain gauge, a shear-type strain gauge, a torsional-type strain gauge, a double-bending-type strain gauge, a half-bridge-type strain gauge, an S-type strain gauge, and a button-type strain gauge.

43. The apparatus, wherein the load cell comprises a piezoelectric load cell.

44. The apparatus, wherein the load cell comprises a hydraulic load cell.

45. An exercise and rehabilitation apparatus, comprising:

a base;

a frame coupled to the base and extending between the base and a top end;

an arm extending between a proximal end coupled to the top end of the frame and a distal end, wherein the arm is movable about a first degree of freedom between a retracted position and an extended position; and a left handle and a right handle, each coupled to the distal end of the arm, wherein each of the left and right handles is movable in a second degree of freedom relative to the arm, and the left and right handles are each configured to be manipulated by a user.

This disclosure is meant to be illustrative of the principles and various embodiments. Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims. Numerous variations and modifications will become apparent to those skilled in the art once the above disclosure is fully appreciated. It is intended that the following claims be interpreted to embrace all such variations and modifications.

The various aspects, implementations or features of the described embodiments can be used separately or in any combination. The embodiments disclosed herein are modular in nature and can be used in conjunction with or coupled to other embodiments.

Consistent with the above disclosure, the examples of assemblies enumerated in the following clauses are specifically contemplated and are intended as a non-limiting set of examples.

What is claimed is:

1. An exercise and rehabilitation apparatus, comprising:

a base;

a frame coupled to the base and having a top end;

an arm having a proximal end coupled to the top end of the frame, and a distal end opposite the proximal end, the arm movable in a first degree of freedom between a retracted position and an extended position relative to the frame and stationary in the retracted position and the extended position respectively; and handles coupled to the arm adjacent the distal end and movable in a second degree of freedom relative to the arm held in the extended position, and the handles are configured to be manipulated by a user for exercise and rehabilitation, wherein the arm is coupled to the top end of the frame at a first pivot, and the first degree of freedom comprises rotation about a first axis of the first pivot, wherein the handles comprise a handle arm coupled to the arm at a second pivot, the handle arm extends from the second pivot and has a far end, the second degree of freedom comprises rotation about a second axis of the second pivot, and the second axis is parallel to and spaced apart from the first axis, and wherein the second pivot comprises a bar extending along the second axis, and a second latch selectively couples the handle arm to rotate with the bar.

2. The apparatus of claim 1, wherein the handles comprise a handgrip assembly coupled to the far end of the handle arm.

3. The apparatus of claim 2, wherein the handgrip assembly is movable relative to the handle arm in a third degree of freedom at a third pivot, such that the handgrip assembly is rotatable about a third axis extending parallel to and spaced apart from the second axis.

4. The apparatus of claim 3, wherein the handgrip assembly is movable relative to the second pivot to adjust a distance between the second pivot and the third pivot.

5. The apparatus of claim 4, wherein the handle arm comprises a first shaft coupled directly to the arm at the second pivot, a second shaft coupled to the handgrip assembly at the third pivot, and a telescopic coupling between the first shaft and the second shaft to adjust a distance between the second pivot and the third pivot.

6. The apparatus of claim 5, wherein the handle arm comprises a third latch to selectively lock the telescopic coupling between the first shaft and the second shaft.

7. The apparatus of claim 6, wherein the handgrip assembly comprises a handlebar configured to be grasped by the user, the handlebar is movable relative to the handle arm in a fourth degree of freedom at a fourth pivot, such that the handlebar is rotatable about a fourth axis extending perpendicular to the third axis.

8. The apparatus of claim 1, wherein the arm is parallel to the base in the extended position, the arm is parallel to the frame in the retracted position, and the arm is transverse to the frame in the extended position.

9. The apparatus of claim 1, wherein the arm is selectively locked at a given position relative to the frame.

10. The apparatus of claim 1, further comprising a monitor support coupled to the arm to support a display screen, the monitor support is slidable along a linear path extending between the proximal and distal ends of the arm, and a fourth latch selectively restrains the monitor support at a fixed location along the linear path.

11. The apparatus of claim 1, further comprising a linkage for coupling the handle to rotate with a pedal, and a fifth latch selectively couples the handle to rotate with the pedal.

12. The apparatus of claim 1, further comprising load cells for measuring forces, and the load cells comprise at least one of a strain gauge, a piezoelectric load cell or a hydraulic load cell.

13. An exercise and rehabilitation apparatus, comprising:

a base;

a frame coupled to the base and having a top end;

an arm having a proximal end coupled to the top end of the frame, and a distal end opposite the proximal end, the arm movable in a first degree of freedom between a retracted position and an extended position relative to the frame and stationary in the retracted position and the extended position respectively;

handles coupled to the arm adjacent the distal end and movable in a second degree of freedom relative to the arm held in the extended position, and the handles are configured to be manipulated by a user for exercise and rehabilitation; and a monitor support coupled to the arm to support a display screen, the monitor support slidable along a linear path extending between the proximal and distal ends of the arm, wherein a fourth latch selectively restrains the monitor support at a fixed location along the linear path.

* * * * *